US012085288B2

(12) United States Patent
Lin et al.

(10) Patent No.: US 12,085,288 B2
(45) Date of Patent: Sep. 10, 2024

(54) AIR CONDITIONER INDOOR UNIT AND AIR CONDITIONER

(71) Applicants: Guangdong Midea White Home Appliance Technology Innovation Center Co., Ltd., Foshan (CN); GD Midea Heating & Ventilating Equipment Co., Ltd., Foshan (CN); Midea Group Co., Ltd., Foshan (CN)

(72) Inventors: Chen Lin, Foshan (CN); Chenzhong Jiang, Foshan (CN); Jiaji He, Foshan (CN); Hiroshi Omori, Foshan (CN); Yu Jiang, Foshan (CN)

(73) Assignees: GUANGDONG MIDEA WHITE HOME APPLIANCE TECHNOLOGY INNOVATION CENTER CO., LTD., Foshan (CN); GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 296 days.

(21) Appl. No.: 17/721,272

(22) Filed: Apr. 14, 2022

(65) Prior Publication Data

US 2022/0235947 A1 Jul. 28, 2022

Related U.S. Application Data

(63) Continuation of application No. PCT/CN2020/138384, filed on Dec. 22, 2020.

(30) Foreign Application Priority Data

Dec. 11, 2020 (CN) ..... 202011443398.8

(51) Int. Cl.
*F24F 1/0011* (2019.01)
*F24F 1/0067* (2019.01)
*F24F 13/20* (2006.01)

(52) U.S. Cl.
CPC ..... *F24F 1/0011* (2013.01); *F24F 1/0067* (2019.02); *F24F 13/20* (2013.01)

(58) Field of Classification Search
CPC ..... F24F 1/0059; F24F 1/0067; F24F 1/01; F24F 13/20; F24F 1/0063
See application file for complete search history.

(56) References Cited

U.S. PATENT DOCUMENTS 5,228,197 A * 7/1993 Cox ..... F24F 13/30 29/890.035
2004/0112574 A1* 6/2004 Repice ..... F24F 1/0067 165/151

(Continued)

FOREIGN PATENT DOCUMENTS

CN 201074879 Y 6/2008
CN 203869162 U 10/2014

(Continued)

OTHER PUBLICATIONS

Midea Group Co., Ltd., ISRWO, PCT/CN2020/138384, Sep. 10, 2021, 8 pgs.

(Continued)

*Primary Examiner* — Lionel Nouketcha
(74) *Attorney, Agent, or Firm* — Morgan, Lewis & Bockius LLP

(57) ABSTRACT

An air conditioner indoor unit includes: a shell having an air inlet and an air outlet, the air outlet is located at the bottom of the shell; and at least one heat exchanger group. The air flows through the air inlet and is subjected to heat exchange via the at least one heat exchanger group, and then flows out from the air outlet. The heat exchanger group includes: a first (Continued)

heat exchanger; a second heat exchanger arranged to be inclined with respect to a first direction, a lower end portion of the second heat exchanger being connected to an upper end portion of the first heat exchanger; a third heat exchanger spaced apart from the first heat exchanger; and a fourth heat exchanger arranged to be inclined with respect to the first direction.

14 Claims, 12 Drawing Sheets

(56) References Cited

U.S. PATENT DOCUMENTS

| | | | | |
|---|---|---|---|---|
| 2005/0150250 | A1* | 7/2005 | Allison | F25C 1/12 62/340 |
| 2009/0308585 | A1* | 12/2009 | Chen | F28F 1/325 165/185 |

FOREIGN PATENT DOCUMENTS

| | | | |
|---|---|---|---|
| CN | 106225087 | A | 12/2016 |
| CN | 109297094 | A | 2/2019 |
| CN | 111497561 | A | 8/2020 |
| EP | 1072846 | A2 | 1/2001 |
| EP | 1568945 | A1 | 8/2005 |
| EP | 1619448 | A1 | 1/2006 |
| EP | 4036485 | A1 | 8/2022 |
| JP | H 0814596 | A | 1/1996 |
| JP | H 1019291 | A | 1/1998 |
| JP | H1019368 | A * | 1/1998 |
| JP | 2002213766 | A | 7/2002 |
| WO | WO 2017042937 | A1 | 3/2017 |

OTHER PUBLICATIONS

Midea Group Co., Ltd., Australian Office Action, CN Patent Application No. 2020471211, Dec. 14, 2022, 4 pgs.

Midea Group Co., Ltd., 1st Chinese Office Action, CN Patent Application No. 202011443398.8, Dec. 20, 2022, 17 pgs.

Midea Group Co., Ltd., 2nd Chinese Office Action, CN Patent Application No. 202011443398.8, Jun. 26, 2023, 9 pgs.

Midea Group Co., Ltd., Extended European Search Report and Supplementary Search Report, EP20955470.8, Dec. 6, 2022, 9 pgs.

Midea Group Co., Ltd., IPRP, PCT/CN2020/138384, Jun. 13, 2023, 5 pgs.

* cited by examiner

AIR CONDITIONER INDOOR UNIT AND AIR CONDITIONER

CROSS-REFERENCES TO RELATED APPLICATIONS

This application is a continuation of International Patent Application No. PCT/CN2020/138384, filed on Dec. 22, 2020, which claims to the benefit of the Chinese Patent Application No. 202011443398.8 filed with the China National Intellectual Property Administration on Dec. 11, 2020 and entitled "Air Conditioner Indoor Unit and Air Conditioner," the entire contents of which are incorporated herein by reference.

FIELD

The present disclosure relates to the technical field of air conditioning equipment, and in particular to an air conditioner indoor unit and an air conditioner.

BACKGROUND

With the development of air conditioning technology, users' demand for air conditioners is not limited to simple temperature and humidity regulation. How to improve the comfort of users' living environment has become the development trend of air conditioning technology. Air conditioners typically use a reduced fan rotational velocity to achieve a "breezeless" air out. However, because the fan is always running during the "breezeless" air out, the operational noise of the fan still affects the user experience.

SUMMARY

The present disclosure is intended to solve at least one of the technical problems existing in the prior art or related art.

To this end, the first aspect of the present disclosure provides an air conditioner indoor unit.

The second aspect of the present disclosure provides an air conditioner.

In view of the above, the first aspect of the present disclosure provides an air conditioner indoor unit, comprising: a shell comprising an air inlet and an air outlet, the air outlet being located at the bottom of the shell along a first direction; and at least one heat exchanger group, the at least one heat exchanger group being provided in the shell, and air flowing through the air inlet to the at least one heat exchanger group for heat exchange and then flowing out from the air outlet, wherein any one of the at least one heat exchanger groups comprises: a first heat exchanger; a second heat exchanger, wherein a first connecting line between an upper end portion and a lower end portion of the second heat exchanger is arranged to be inclined with respect to the first direction, and the lower end portion of the second heat exchanger is provided adjacent to an upper end portion of the first heat exchanger; a third heat exchanger spaced from the first heat exchanger along a second direction; and a fourth heat exchanger, wherein a second connecting line between an upper end portion and a lower end portion of the fourth heat exchanger is arranged to be inclined with respect to the first direction, and the lower end portion of the fourth heat exchanger is connected to the upper end portion of the third heat exchanger, wherein the upper end portion of the fourth heat exchanger is connected to the upper end portion of the second heat exchanger, the first direction is perpendicular to the second direction, the first direction is a direction of gravity, projection is performed along the first direction, and an intersection point of an extension line of the first connecting line and an extension line of the second connecting line is located between the first heat exchanger and the third heat exchanger.

The present disclosure provides an air conditioner indoor unit comprising a shell and at least one heat exchanger group. The shell comprises an air inlet and an air outlet, and any one heat exchanger group comprises a first heat exchanger, a second heat exchanger, a third heat exchanger, and a fourth heat exchanger. The first heat exchanger, the second heat exchanger, the third heat exchanger, and the fourth heat exchanger are all located inside the shell, and the air outlet is located at the bottom of the shell. The first heat exchanger and the third heat exchanger are provided on two sides in the shell along the second direction, and the lower end portion of the second heat exchanger is adjacent to the upper end portion of the first heat exchanger and located above the first heat exchanger. The lower end portion of the fourth heat exchanger is adjacent to the upper end portion of the third heat exchanger and located above the third heat exchanger. The first connecting line between the upper end portion and the lower end portion of the second heat exchanger and the second connecting line between the upper end portion and the lower end portion of the fourth heat exchanger are both arranged to be inclined with respect to the first direction, i.e., the direction of gravity.

When the air conditioner indoor unit is in operation, the indoor air flows into the indoor from the air outlet after heat exchange via the air inlet, the first heat exchanger, and the second heat exchanger on one side of the shell, and the indoor air flows into the indoor from the air outlet after heat exchange via the air inlet, the third heat exchanger, and the fourth heat exchanger on the other side of the shell. That is to say, when the natural convection refrigeration mode is running, the indoor air can be subjected to heat exchange by natural convection, and the whole heat exchange process does not require the fan to work such that the noise generated by the operation of the fan is avoided under the condition of ensuring a good heat exchange capability, thereby improving the user comfort.

Further, by arranging the second heat exchanger and the fourth heat exchanger to be inclined in the shell, the inner space of the shell can be effectively used, the space occupied by the second heat exchanger and the fourth heat exchanger in the vertical direction is reduced, then the heat exchange area of the heat exchanger is increased, and then the air volume of the inlet air after the heat exchange can be increased to meet the demand for refrigerating capacity during the air inlet of the natural convection such that the user's comfort and satisfaction are greatly improved. It can realize the situation that when an air conditioner is used in a bedroom scenario the user would not be affected by blowing and noises as the user has a good body temperature while sleeping, namely, the air conditioner indoor unit has the effects of breezeless air-out and no noise, and is suitable for popularization and application.

In addition, the air conditioner indoor unit in the above-mentioned embodiments provided by the present disclosure may further have the following additional technical features.

In the above embodiments, further, a cross-sectional shape constituted by the second heat exchanger and the fourth heat exchanger is an inverted V-shape in a cross-section perpendicular to a third direction, wherein the third direction is perpendicular to both the first direction and the second direction.

In any of the above embodiments, the following is further included: a jet nozzle located between the upper end portion of the fourth heat exchanger and the upper end portion of the second heat exchanger, the jet nozzle enclosing with any one of the heat exchanger groups to form a heat exchange chamber, and the heat exchange chamber being in communication with the air outlet.

In any of the above embodiments, the following is further included: a jet air channel being in communication with the jet nozzle, a cross-sectional area of the jet air channel gradually decreasing along a flow direction of the jet air channel.

In any of the above embodiments, at least one heat exchanger group comprises multiple heat exchanger groups, wherein the multiple heat exchanger groups are successively spaced apart along the second direction of the shell, and any one of the heat exchanger groups is correspondingly provided with the jet nozzle.

In any of the above embodiments, further, the shell comprises: an air inlet cover body, the air inlet being opened on the air inlet cover body; a base, the air inlet cover body being provided on the base, and the air outlet being opened on the base; and a partition plate, being provided between the air inlet cover body and the base, the partition plate being connected to the air inlet cover body and the base, wherein the at least one heat exchanger group is connected to the partition plate.

In any of the above embodiments, further, any one of the heat exchanger groups is an axisymmetric structure having an axis of symmetry extending along the first direction.

In any of the above embodiments, further, the second heat exchanger comprises multiple second fins, and the inclination angle of the second fin with respect to the first direction ranges from 0° to 45°, the fourth heat exchanger includes multiple fourth fins and an inclination angle of the fourth fin with respect to the first direction ranges from 0° to 45°.

In any of the above embodiments, further, along the second direction, the ratio of a width of the air outlet to the width of the shell ranges from 0.2 to 0.9; and/or a ratio of a width of the air outlet along the second direction to a distance from an end face of the jet nozzle to a plane where the air outlet is located ranges from 0.1 to 0.7.

In any of the above embodiments, further, projection is performed along the first direction of the shell to a plane perpendicular to the first direction, in an obtained projection plane, a width of at least one heat exchanger group is equal to a difference value between the width of the shell and a width of the jet nozzle.

In any of the above embodiments, further, the air inlet is higher than the lower end portion of at least one heat exchanger group at one side of the air outlet along the first direction of the shell.

In any of the above embodiments, further, the first heat exchanger comprises multiple first heat exchange tubes and multiple first fins, wherein the multiple first heat exchange tubes are all arranged in a single row, and multiple first fins are sleeved on the first heat exchange tubes, the second heat exchanger comprises multiple second heat exchange tubes and multiple second fins, wherein the multiple second heat exchange tubes are all arranged in a single row, and the multiple second fins are sleeved on the second heat exchange tubes, the third heat exchanger comprises multiple third heat exchange tubes and multiple third fins, wherein the multiple third heat exchange tubes are all arranged in a single row, and the multiple third fins are sleeved on the third heat exchange tubes, the fourth heat exchanger comprises multiple fourth heat exchange tubes and multiple fourth fins, wherein the multiple fourth heat exchange tubes are arranged in a single row, and the multiple fourth fins are sleeved on the fourth heat exchange tubes.

In any of the above embodiments, further, the air inlet comprises a jet air inlet and the main air inlet, wherein the jet air inlet is in communication with the jet nozzle, and the main air inlet is in communication with the heat exchange chamber via the at least one heat exchanger group, the jet air inlet is opened on a side wall of the shell, the main air inlet is opened on two side walls of the shell which are opposite along the second direction, and the main air inlet is opened on a side wall of the shell along a third direction, and/or a top wall of the shell.

According to a second aspect of the present disclosure, there is provided an air conditioner comprising: the air conditioner indoor unit according to any one of the above embodiments of the first aspect.

The air conditioner provided by the present disclosure comprises the air conditioner indoor unit of any embodiment of the above first aspect. Accordingly, it has all the advantageous effects of the air conditioner indoor unit of the first aspect described above which will not be described in detail herein.

The additional aspects and advantages of the present disclosure will become apparent in the description below, or learned by practice of the present disclosure.

BRIEF DESCRIPTION OF THE DRAWINGS

The foregoing and/or additional aspects and advantages of the present disclosure will become apparent and readily understood from the following description of the embodiments taken in conjunction with the accompanying drawings. Wherein.

Figure 1:
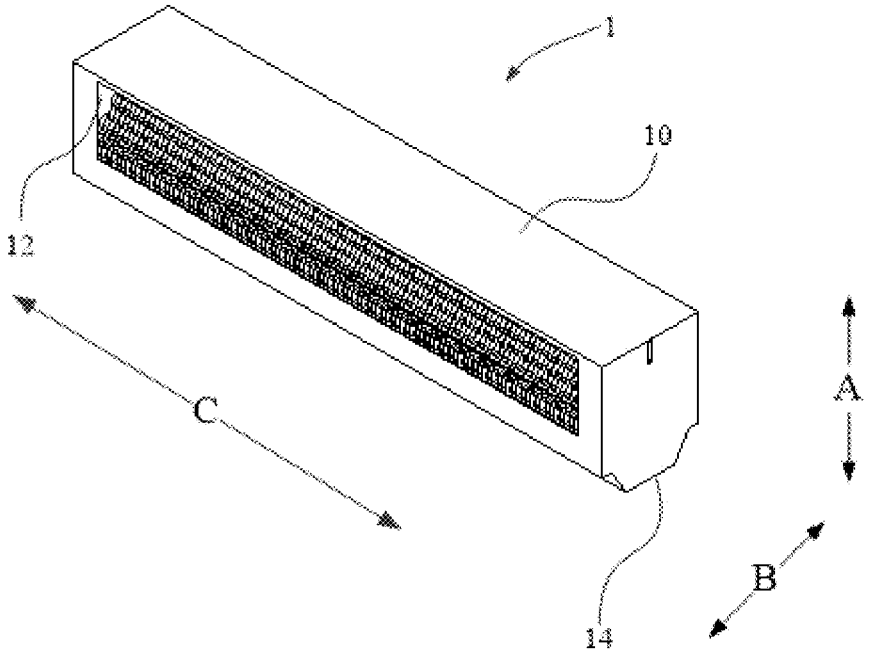
FIG. 1 is a schematic view illustrating a structure of an air conditioner indoor unit provided according to first embodiments of the present disclosure.
Figure 26:
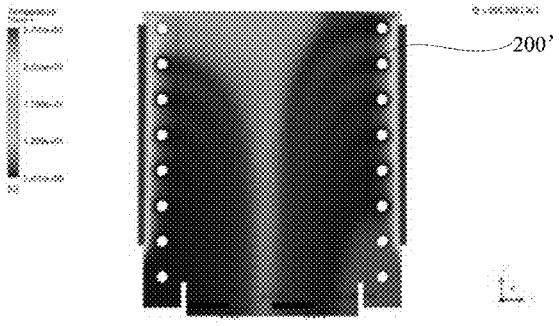
FIG. 26 shows an effect drawing of the temperature distribution inside a shell under no jet heat exchange condition provided by some embodiments of the related art.
Figure 27:
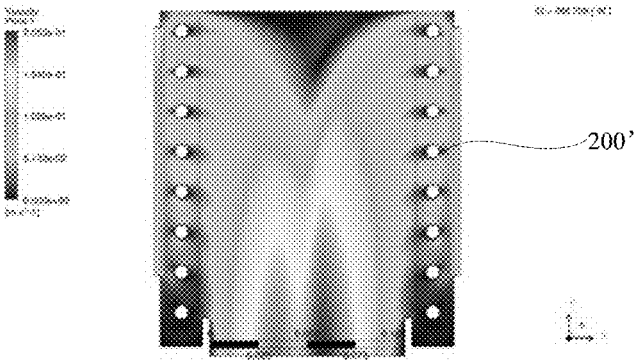
FIG. 27 shows an effect drawing of the velocity distribution inside a shell under no jet heat exchange condition provided by some embodiments of the related art.

Wherein the corresponding relationships between the reference numerals and component names in FIGS. 1-25 are:

1 air conditioner indoor unit, 10 shell, 102 base, 104 air inlet cover body, 12 air inlet, 120 jet air inlet, 122 main air inlet, 14 air outlet, 16 heat exchange chamber, 20 first heat exchanger, 22 second heat exchanger, 24 third heat exchanger, 26 fourth heat exchanger, 30 jet structure, 32 air channel, 322 air supplying air channel, 324 jet air channel, 34 jet nozzle, 40 fan, 50 partition plate, 52 first heat exchange chamber, 54 second heat exchange chamber, 60 first water receiving tray, 62 second water receiving tray.

Wherein the corresponding relationship between the reference numeral and component name in FIGS. 26 and 27 is:

200', heat exchanger.

DETAILED DESCRIPTION OF THE DISCLOSURE

In order to make the above objects, features, and advantages of the present disclosure more clearly understood, a more particular description of the present disclosure will be rendered below by reference to specific implementation modes and the appended drawings. It should be noted that the embodiments and features of the embodiments of the present disclosure can be combined with each other without conflict.

In the following description, numerous specific details are set forth in order to provide a thorough understanding of the present disclosure. However, the present disclosure may be implemented otherwise than as described herein, and accordingly, the scope of the present disclosure is not limited by the specific embodiments disclosed below.

An air conditioner indoor unit 1 and an air conditioner according to some embodiments of the present disclosure are described below with reference to FIGS. 1 to 25.

EMBODIMENTS 1

As shown in FIG. 1 to FIG. 20, according to a first aspect of the present disclosure, there is provided an air conditioner indoor unit 1, comprising a shell 10 and at least one heat exchanger group arranged in the shell 10. The shell 10 comprises an air inlet 12 and an air outlet 14, wherein along a first direction, the air outlet 14 is located at the bottom of the shell 10, and the air flows through the air inlet 12 to at least one heat exchanger group for heat exchange and then flows out from the air outlet 14.

Any one of the at least one heat exchanger groups comprises: a first heat exchanger 20; a second heat exchanger 22, wherein a first connecting line between an upper end portion and a lower end portion of the second heat exchanger 22 is provided obliquely with respect to the first direction, and the lower end portion of the second heat exchanger 22 is provided adjacent to the upper end portion of the first heat exchanger 20; a third heat exchanger 24 which is spaced apart from the first heat exchanger 20 in a second direction; and a fourth heat exchanger 26, wherein a second connecting line between the upper end portion and the lower end portion of the fourth heat exchanger 26 is provided obliquely with respect to the first direction, and the lower end portion of the fourth heat exchanger 26 is provided adjacent to the upper end portion of the third heat exchanger 24, wherein the upper end portion of the fourth heat exchanger 26 is connected to the upper end portion of the second heat exchanger 22, the first direction is perpendicular to the second direction, the first direction is a gravity direction, the projection is performed along the first direction, and the intersection point of the extension line of the first connecting line and the extension line of the second connecting line is located between the first heat exchanger 20 and the third heat exchanger 24.

Figure 2:
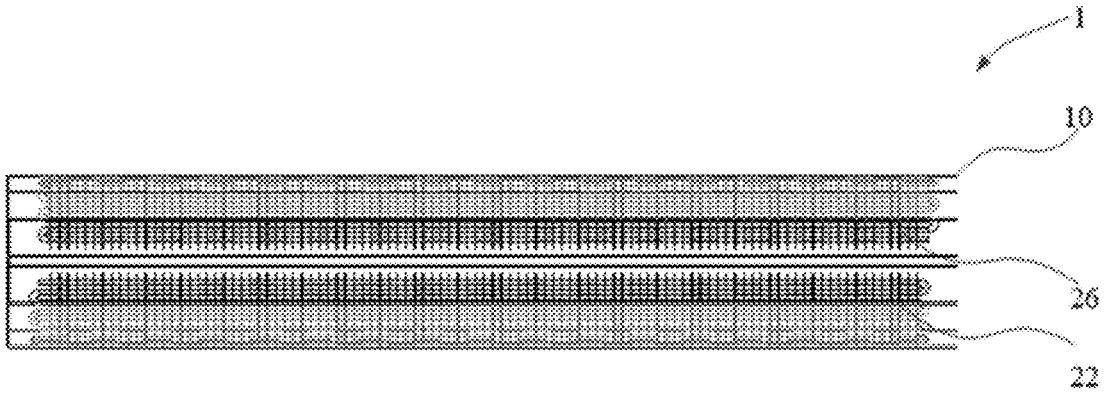
FIG. 2 shows a schematic view of the structure of the embodiments of FIG. 1 from a first viewing angle.
Figure 3:
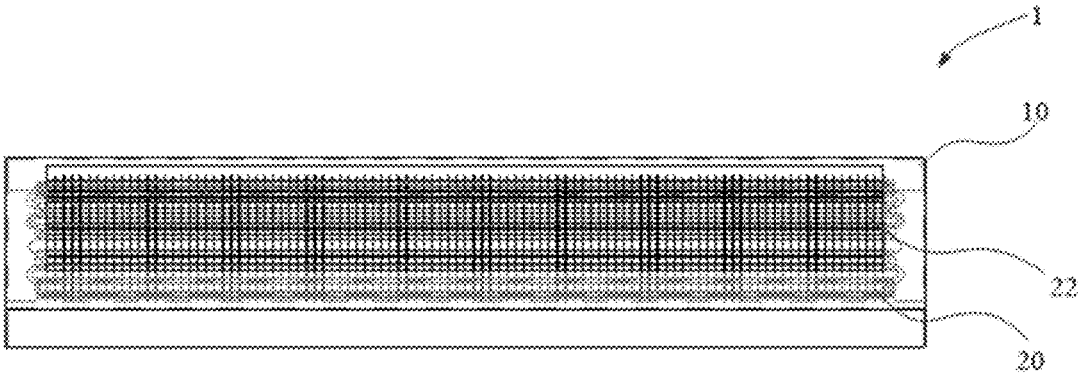
FIG. 3 shows a schematic view of the structure of the embodiments of FIG. 1 from a second viewing angle.

The present disclosure provides an air conditioner indoor unit 1 comprising a shell 10 and at least one heat exchanger group. Wherein, as shown in FIGS. 1 to 3, the shell 10 includes an air inlet 12 and an air outlet 14. Any heat exchanger group includes a first heat exchanger 20, a second heat exchanger 22, a third heat exchanger 24, and a fourth heat exchanger 26. The first heat exchanger 20, the second heat exchanger 22, the third heat exchanger 24, and the fourth heat exchanger 26 are all located inside the shell 10, and the air outlet 14 is located at the bottom of the shell 10. The first heat exchanger 20 and the third heat exchanger 24 are provided at both sides in the shell 10 in the second direction, and the second heat exchanger 22 is connected to and positioned above the first heat exchanger 20. The fourth heat exchanger 26 is connected to and positioned above the third heat exchanger 24. Both the second heat exchanger 22 and the fourth heat exchanger 26 are provided obliquely with respect to the first direction, i.e., the direction of gravity.

Figure 4:
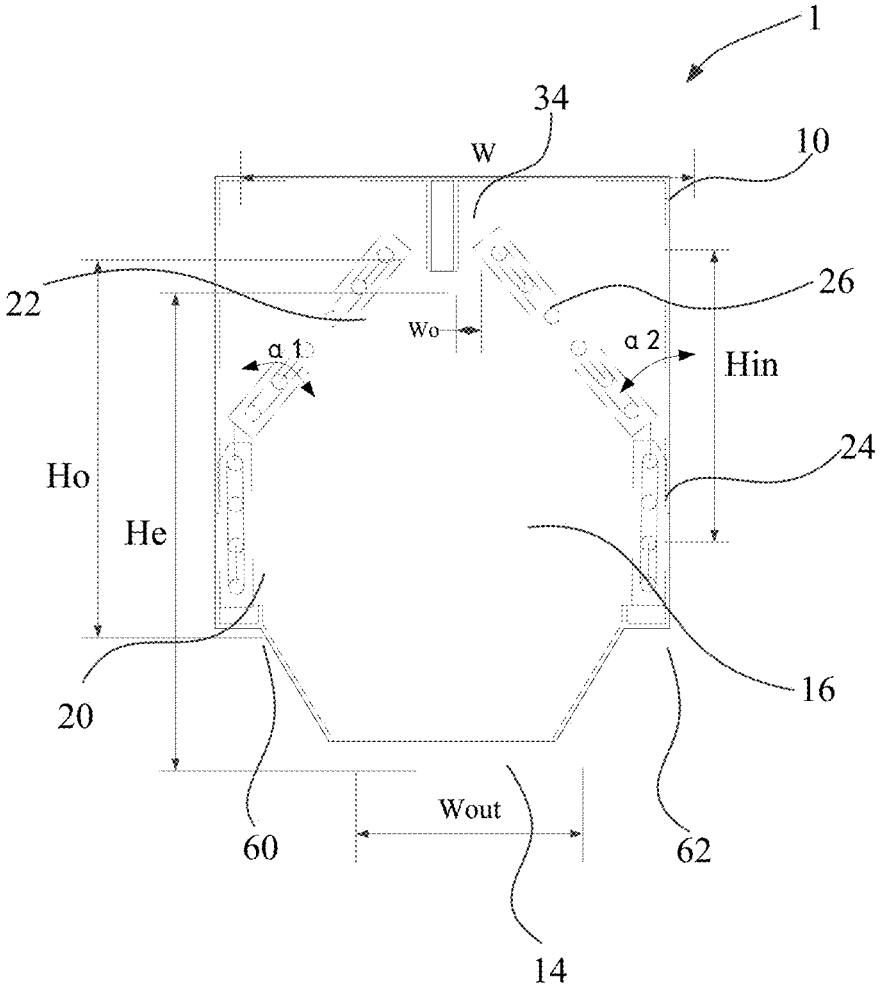
FIG. 4 shows a schematic view of the structure of the embodiments of FIG. 1 from a third viewing angle.

Specifically, as shown in FIGS. 2 to 4, the first heat exchanger 20, the second heat exchanger 22, the third heat exchanger 24, and the fourth heat exchanger 26 are provided in the shell 10. In the first direction, the second heat exchanger 22 and the fourth heat exchanger 26 are respectively located above the first heat exchanger 20 and the third heat exchanger 24. As shown in FIG. 4, the side walls of the two opposite sides of the shell 10 extend in the first direction, and the second heat exchanger 22 and the fourth heat exchanger 26 are both provided obliquely with respect to the first direction, namely, the second heat exchanger 22 and the fourth heat exchanger 26 are provided obliquely with respect to the side wall of the shell.

Further, as shown in FIG. 4, two surfaces of the second heat exchanger 22 opposite in the first direction are angled with respect to the side wall of the shell. In a similar way, two surfaces of the fourth heat exchanger 26 opposite in the first direction are angled with respect to the side wall of the shell. By arranging both the second heat exchanger 22 and the fourth heat exchanger 26 to be oblique with respect to the first direction, the inner space of the shell 10 can be effectively used such that the space occupied by the second heat exchanger 22 and the fourth heat exchanger 26 in the vertical direction is reduced. Then the first heat exchanger 20 and the third heat exchanger 24 can be further provided, thereby increasing the heat exchange area of the heat exchangers, and then the air volume of the intake air after the heat exchange can be increased to meet the demand for refrigerating capacity during natural convection air intake.

Further, in the first direction, the upper end portion of the first heat exchanger 20 overlaps with the lower end portion of the second heat exchanger 22, thereby ensuring that the air flow entering through the air inlet can be discharged after heat exchange so as to improve the heat exchange effect; the upper end portion of the third heat exchanger 24 overlaps with the lower end portion of the fourth heat exchanger 26 to ensure that the air flow entering through the air inlet on the other side can also be discharged after heat exchange to improve the heat exchange effect.

Further, the upper end portion of the second heat exchanger 22 and the upper end portion of the fourth heat exchanger 26 are connected via a shell such that the first heat exchanger 20, the second heat exchanger 22, the third heat exchanger 24, and the fourth heat exchanger 26 enclose to form a heat exchange chamber 16. The air flow entering through the air inlet 12 passes through the heat exchanger group and then enters the heat exchange chamber 16, thereby ensuring that the air entering the heat exchange chamber 16 is the air flow after heat exchange, so as to improve the heat exchange effect of the whole machine.

The arrangement of the above-mentioned heat exchanger is applicable to different types of heat exchangers and is not limited to a certain type of heat exchanger.

The specific working process is as follows: the indoor return airflow enters the shell 10 from the air inlet 12, and passes through the heat exchange chamber 16 formed by enclosing the first heat exchanger 20, the second heat exchanger 22, the third heat exchanger 24, and the fourth heat exchanger 26; due to the increased density, the cold air after cooling will flow out from the air outlet 14 and be sent into the room under the action of gravity; the hot air in the indoor will re-enter the air inlet 12 in the form of the return air, thereby forming an airflow circulation and performing heat exchange on the indoor space. Under the working mode of natural convection, with regard to the indoor unit, the fan 40 does not need to work, so as to achieve the effect of silent heat exchange and breezeless heat exchange, greatly improving the user's comfort.

Further, as shown in FIG. 4, any one heat exchanger group comprises a second heat exchanger 22 and a fourth heat exchanger 26 located in an upper portion of the shell 10, and a first heat exchanger 20 and a third heat exchanger 24 located in a lower portion of the shell 10. The first heat exchanger 20 and the third heat exchanger 24 are respectively located below the second heat exchanger 22 and the fourth heat exchanger 26, and the connecting ends of the first heat exchanger 20 and the second heat exchanger 22 overlap each other via a fin, and the connecting ends of the third heat exchanger 24 and the fourth heat exchanger 26 overlap each other via a fin, and then the first heat exchanger 20, the second heat exchanger 22, the third heat exchanger 24, and the fourth heat exchanger 26 enclose to form the heat exchange chamber 16. The first heat exchanger 20, the second heat exchanger 22, the third heat exchanger 24, and the fourth heat exchanger 26 are all capable of performing heat exchange on the airflow entering through the air inlet 12 of the shell 10, so as to increase the heat exchange area of the whole machine, and at the same time, capable of performing heat exchange on the indoor return air entering from the air inlet 12 in a maximum manner, and further capable of providing a great heat exchange capability for the natural convection mode in the case where the shell 10 is compact in volume, thereby greatly improving the user's comfort and satisfaction, and making it capable of satisfying the condition that the air conditioner used in a bedroom scenario offers a good body temperature when the user sleeps, without subjecting the user to the influence of blowing air and noises, that is, the air conditioner indoor unit 1 has the effects of breezeless air out and no noise, making it suitable for popularization and application.

Further, as shown in FIG. 1, it is defined that a direction along the height of the shell 10, i.e., a direction indicated by an arrow A in the drawing, is a first direction (gravity direction), a direction along the width of the shell 10, i.e., a direction indicated by an arrow B in the drawing, is a second direction, and a direction along the length of the shell 10, i.e., a direction indicated by an arrow C in the drawing, is the third direction. Wherein the third direction is perpendicular to both the first direction and the second direction.

EMBODIMENTS 2

In some embodiments of the present disclosure, as shown in FIG. 4, FIG. 10, FIG. 15, FIG. 18, and FIG. 20 to FIG. 25, the cross-sectional shape formed a second heat exchanger 22 and a fourth heat exchanger 26 in a cross-section perpendicular to the third direction is an inverted V-shape.

In these embodiments, the second heat exchanger 22 and the fourth heat exchanger 26 constitute an inverted V-shape, it being understood that the above V-shape refers to a V-like shape. The V-shaped opening faces the air outlet 14 side, and a first heat exchanger 20 and a third heat exchanger 24 overlap with one side of the second heat exchanger 22 and one side of the fourth heat exchanger 26 facing the air outlet 14, respectively.

Specifically, as shown in FIG. 4, a distance between one end of the second heat exchanger 22 near the top of the shell 10 and one end of the fourth heat exchanger 26 near the top of the shell 10 is defined as a first distance, and a distance between one end of the second heat exchanger 22 near the air outlet 14 and one end of the fourth heat exchanger 26 near the air outlet 14 is defined as a second distance. By virtue of the first distance being smaller than the second distance, i.e., by virtue of the second heat exchanger 22 and the fourth heat exchanger 26 constituting an inverted V-shaped heat exchange structure, two end sides of the open side of the V-shape are immediately provided with the first heat exchanger 20 and the third heat exchanger 24, respectively, and the first heat exchanger 20 and the third heat exchanger 24, in the first direction indicated by the arrow A in the figure, are located below the second heat exchanger 22 and the fourth heat exchanger 26, respectively.

Specifically, after the airflow entering the shell 10 via the air inlet 12 acts on the obliquely arranged second heat exchanger 22 and fourth heat exchanger 26, it can sink smoothly and quickly in the shell 10. During the sinking process, it merges with the airflow entering the shell 10 via the first heat exchanger 20 and the third heat exchanger 24 and sinks together, and then flows into the room via the air outlet 14 located at the bottom of the shell 10, that is to say, the obliquely arranged second heat exchanger 22 and fourth heat exchanger 26 enhance the effect of air sinking of the natural convection. In cooperation with the first heat exchanger 20 and the third heat exchanger 24, the air conditioner indoor unit 1 improves the heat exchange capability and the airflow flowing to the air outlet 14 after heat exchange is made more uniform, contributing to the fact that the indoor temperature can quickly reach the user's comfort and can be maintained in a comfortable range for a long time to ensure a good heat exchange effect, such as a good refrigeration effect.

Specifically, when no ejection effect exists, the heat exchanger 200' of the air conditioner indoor unit 1 of the related art is not obliquely arranged, i.e., the heat exchanger 200' is placed along the height direction of the shell 10. The flow of the cold air sinking, due to the slight airflow change outside, is liable to cause asymmetry and instability of the internal flow field, and the refrigerating capacity is weak. FIGS. 26 and 27 illustrate effect drawings of temperature and velocity distribution inside a shell without jet heat exchange provided by embodiments of the related art.

Figure 24:
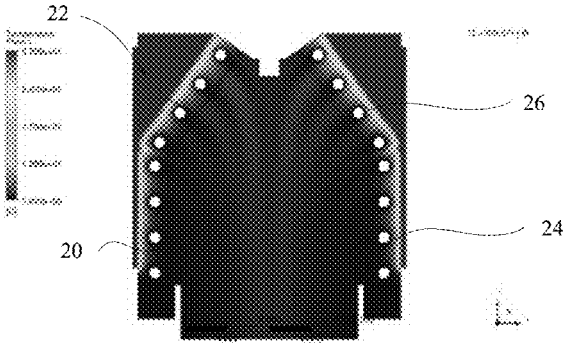
FIG. 24 shows an effect drawing of the temperature distribution inside a shell under natural convection heat exchange conditions provided by some embodiments of the present disclosure.
Figure 25:
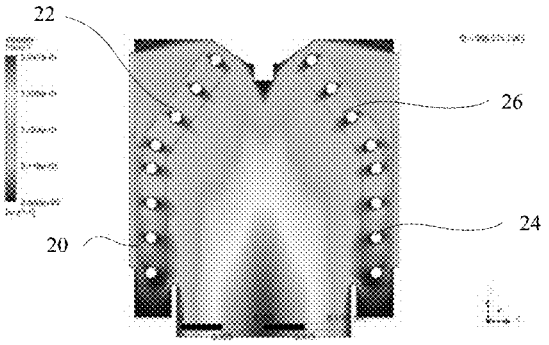
FIG. 25 shows an effect drawing of the velocity distribution inside a shell under natural convection heat exchange conditions provided by some embodiments of the present disclosure.

However, in the present disclosure, the second heat exchanger 22 and the fourth heat exchanger 26 are provided obliquely with respect to the height direction of the shell 10, the second heat exchanger 22 and the fourth heat exchanger 26 constitute an inverted V-shape, the first heat exchanger 20 and the third heat exchanger 24 are respectively provided immediately at two sides of the V-shaped opening, and the first heat exchanger 20 and the third heat exchanger 24 are located at one side of the air outlet 14 such that the heat exchanger group can generate strong natural convection refrigerating capacity. FIGS. 24 and 25 show the effect drawings of temperature and velocity distribution inside the shell 10 in the case of no jet heat exchange provided by embodiments of the present disclosure. It can be seen from the comparison of FIG. 24, FIG. 25 and FIG. 26, FIG. 27 that in the case of no jet, the internal flow field of the air conditioner indoor unit 1 of the present disclosure is very symmetrical and uniform and is not changed by a slight airflow change in the outside, and the refrigerating capacity is improved by at least 7% compared with the prior art.

EMBODIMENTS 3

In any of the above embodiments, as shown in FIGS. 1, 2, and 4, FIGS. 8 to 10, and FIGS. 15 to 20, the air conditioner indoor unit 1 further includes: a jet nozzle 34, wherein the jet nozzle 34 is located between the upper end portion of the fourth heat exchanger 26 and the upper end portion of the second heat exchanger 22, and the jet nozzle 34 encloses with any one heat exchanger group to form a heat exchange chamber 16, and the heat exchange chamber 16 is in communication with the air outlet 14.

In these embodiments, the air conditioner indoor unit 1 further includes a jet nozzle 34, the jet nozzle 34 being located between the second heat exchanger 22 and the fourth heat exchanger 26 and abutting the upper end portions of the second heat exchanger 22 and the fourth heat exchanger 26 such that the first heat exchanger 20, the second heat exchanger 22, the third heat exchanger 24, the fourth heat exchanger 26, and the jet nozzle 34 enclose to form the heat exchange chamber 16 communicated with the air outlet 14.

Figure 21:
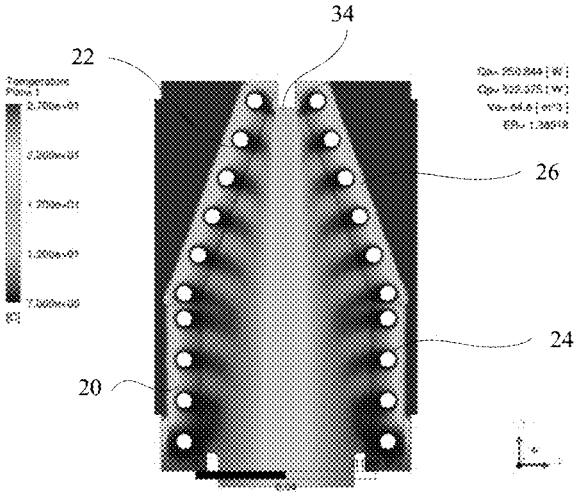
FIG. 21 shows an effect drawing of the heat exchange capability calculation for the case of jet heat exchange and natural convection heat exchange as provided by some embodiments of the present disclosure.
Figure 22:
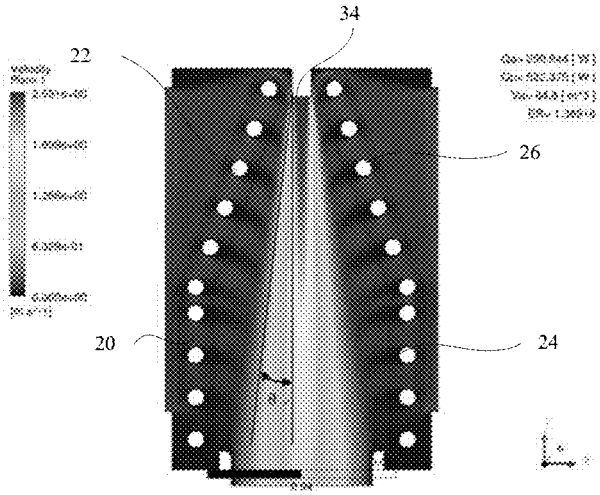
FIG. 22 shows a schematic effect drawing of a jet angle provided by some embodiments of the present disclosure.
Figure 23:
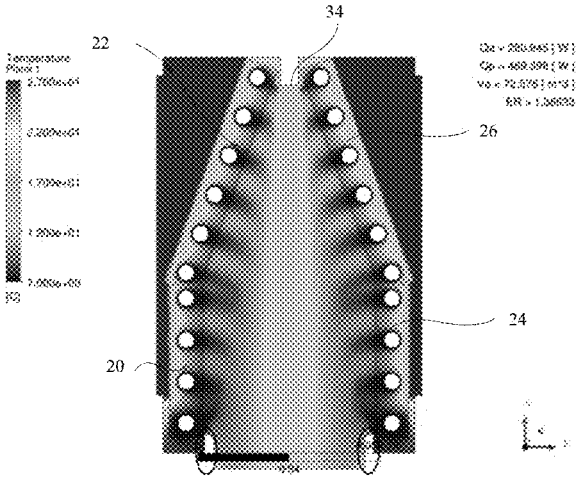
FIG. 23 shows an effect drawing of two-sided wall surface backflow caused by a jet angle that does not meet design requirements as provided by some embodiments of the present disclosure.

Specifically, as shown in FIGS. 21 to 23, when the air conditioner indoor unit 1 is running, the jet nozzle 34 can inject the jet into the heat exchange chamber 16, mix with the airflow, which enters the heat exchange chamber 16 through the air inlet 12, the first heat exchanger 20, the second heat exchanger 22, the third heat exchanger 24, and the fourth heat exchanger 26, and then flow to the indoor through the air outlet 14 to realize heat exchange such that the airflow flowing into the indoor through the air outlet 14 includes two portions of airflow of both the natural convection and the jet flow. At the same time, when the jet is ejected, negative pressure can be formed in the heat exchange chamber 16, thereby increasing the airflow volume of the natural convection, i.e., realizing the effect of joint heat exchange of the natural convection and the jet flow, and greatly improving the heat exchange capability of the indoor unit.

Further, as shown in FIGS. 5, 6 to 10, and 15 to 20, the air conditioner indoor unit 1 further includes a jet air channel 324, wherein the jet air channel 324 is communicated with the jet nozzle 34, and the cross-sectional area of the jet air channel 324 gradually decreases along the flow direction of the airflow in the air channel.

Figure 5:
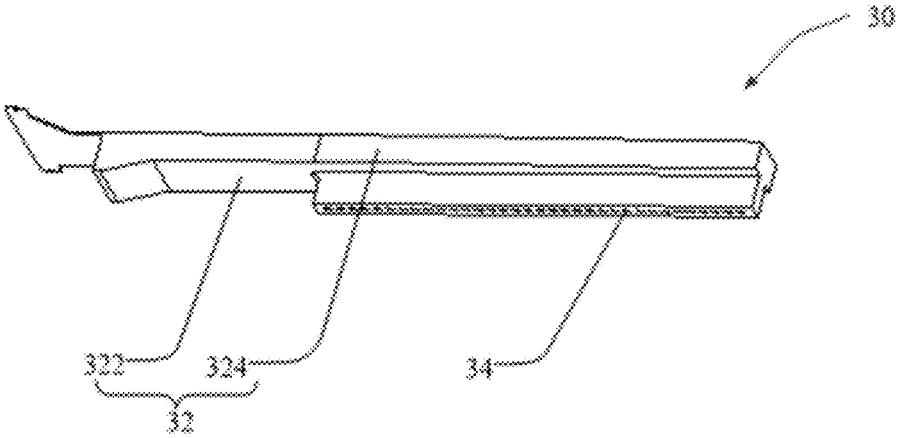
FIG. 5 shows a schematic view of the structure of a jet structure according to first embodiments of the present disclosure.
Figure 6:
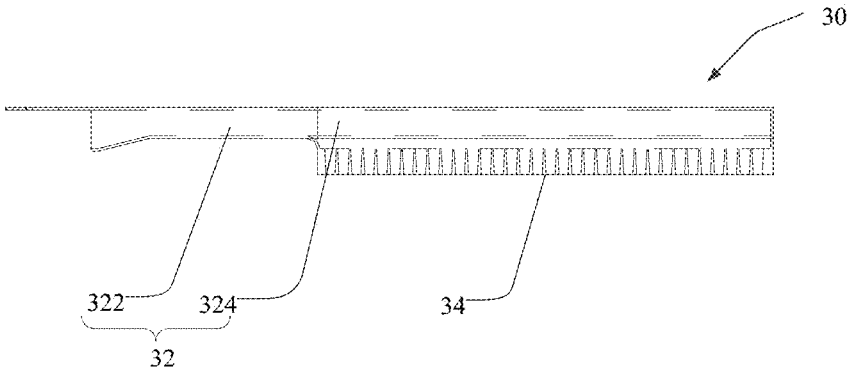
FIG. 6 shows a schematic view of the structure of a jet structure according to second embodiments of the present disclosure.
Figure 7:
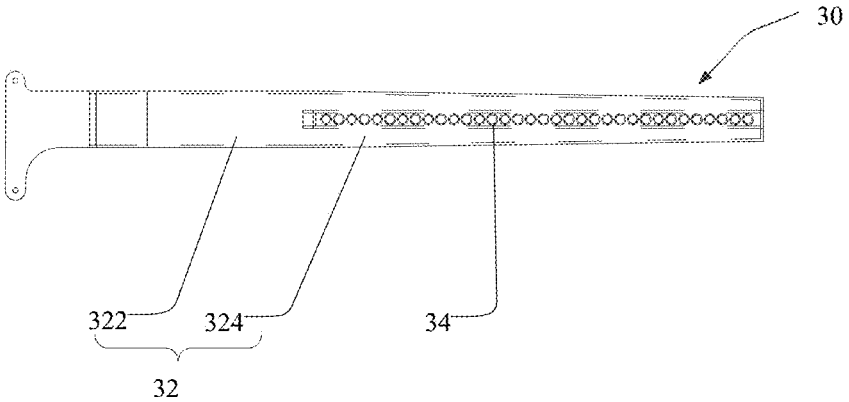
FIG. 7 shows a schematic view of the structure of a jet structure according to third embodiments of the present disclosure.

In these embodiments, as shown in FIGS. 5 to 7, the cross-sectional area of the jet air channel 324 gradually decreases from the air inlet end to the tail end of the jet air channel 324, so that a relatively stable wind pressure can be maintained during the transportation of the air, and the component velocity of the air out along the length direction of the jet air channel 324 is eliminated, thereby making the air velocity ejected by each jet nozzle 34 relatively uniform.

Here, the shape of the jet nozzle 34 may be a circular hole, a bar-shaped hole, or a polygonal hole, and the number of the jet nozzles 34 is multiple. Alternatively, the jet nozzle 34 is an elongated opening structure that extends along a direction consistent with the jet air channel 324. By providing a nozzle, the injection velocity of the entered airflow can be further adjusted, and then it is injected into the heat exchange chamber 16 through the jet nozzle 34, so as to realize the function of guiding the airflow inlet by natural convection and accelerate the heat exchange efficiency.

Figure 8:
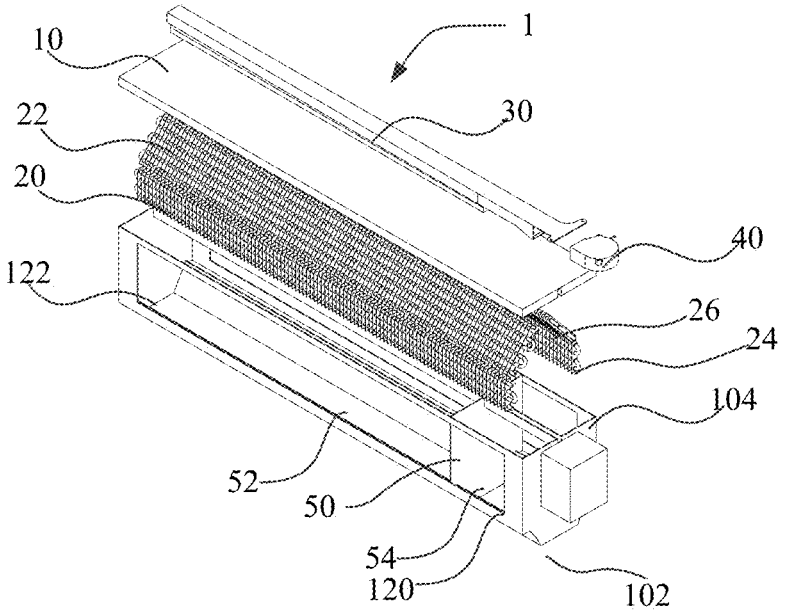
FIG. 8 shows an explosive view of an air conditioner indoor unit provided according to second embodiments of the present disclosure.

Specifically, as shown in FIGS. 7 and 8, a fan 40 and an air supplying air channel 322 are further included, wherein an air supply port of the fan 40 is in communication with the air supplying air channel 322, and the air supplying air channel 322 is in communication with the jet air channel 324, so as to realize active air supply through the jet nozzle 34. Therefore, the air sent out from air outlet 14 is composed of two parts, one part being jet air and the other part being drained air. Therefore, the effect of providing greater air volume and refrigerating capacity with a small amount of active air supply is achieved, and the energy efficiency of the air conditioner can be greatly improved when the active air supply volume maintains the air volume level of the traditional air conditioners, which is beneficial to reducing the cost of use.

In some specific embodiments, FIG. 21 shows an effect drawing of the heat exchange capability calculation for the case of j et heat exchange and natural convection heat exchange as provided by some embodiments of the present disclosure; it can be seen from FIG. 21 that the refrigerating capacity delivered to the indoor after performing jet flow through the jet air inlet 120 is 250 W, while the refrigerating capacity delivered to the indoor after the natural convection of the airflow which is drained through the main air inlet 122 is 522 W, namely, the refrigerating capacity of the drained achieved by the main air inlet 122 is about 2 times of the refrigerating capacity of the jet flow achieved by the jet air inlet 120.

Further, along the airflow entering direction, the cross-sectional area of the air inlet end of the jet air channel 324 is taken as a first area, and the cross-sectional area of the tail end of the jet air channel 324 is taken as a second area, wherein the value of the second area is 10% to 80% of the first area; by adjusting the tapering amplitude of the jet air channel 324, a reasonable structure can be set in combination with the whole machine structure of the air conditioner indoor unit 1, and the heat exchange area of the heat exchanger, and the size of the heat exchange chamber, so as to achieve a good air-out velocity and air-out volume, and improve the output capability and comfort of the whole machine.

Further, the port area of the air inlet end of the overall jet nozzle 34 is a third area, the flow area of the outlet end of all the jet nozzles 34 is a fourth area, and the value of the fourth area is 50% to 95% of the third area; by setting the flow area of the jet nozzle 34 as a tapered structure from the air inlet end to the air outlet end, the flow rate of the airflow ejected out through the jet nozzle 34 can be further increased, thereby achieving the flow guiding function on the airflow of natural convection and improving the heat exchange efficiency.

Further, along the first direction of the shell 10, projection is performed on a plane perpendicular to the first direction; in the obtained projection plane, the width of the heat exchanger group is equal to the difference value between the width of the shell 10 and the width of the jet nozzle 34.

Figure 15:
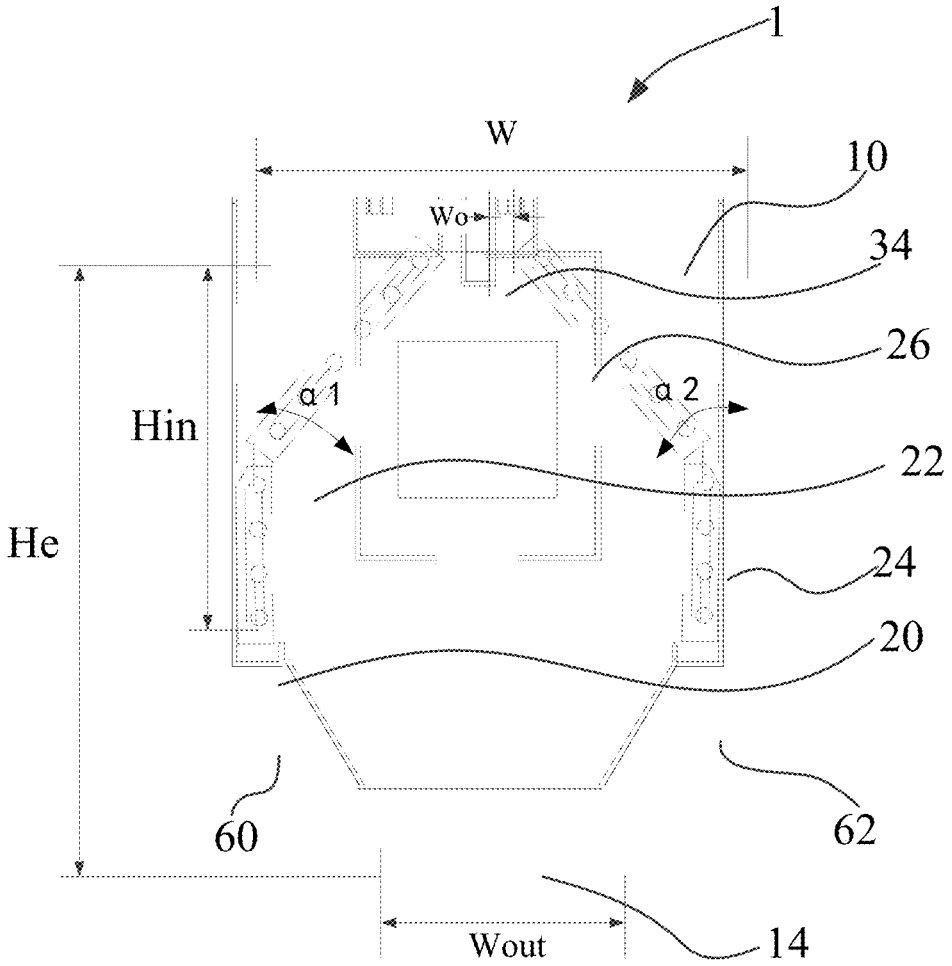
FIG. 15 shows a schematic view of the structure of the embodiments shown in FIG. 12 from a third viewing angle.

In these embodiments, as shown in FIG. 1, FIG. 4, and FIG. 15, the sum of the width of the heat exchanger group and the width Wo of the jet nozzle 34 is equal to the width W of the shell 10 in a projection plane obtained by performing projection on a plane perpendicular to the direction of gravity. That is, the heat exchanger group and the jet nozzle 34 are closely arranged inside the shell 10 in the width direction of the shell 10, and the inner space of the shell 10 is sufficiently utilized, which is advantageous in providing a large heat exchange capability in the case where the shell 10 is compact in volume. At the same time, the arrangement in this way is beneficial to reduce the gap between the heat exchanger group and the shell 10, so that the airflow flowing into the inside of the shell 10 via the air inlet 12, as much as possible, exchanges heat via the heat exchanger group and then flows out via the air outlet 14, which is beneficial to improve the heat exchange effect of the air conditioner indoor unit, reduce energy loss, and improve the energy efficiency of the air conditioner.

It should be noted that, in practice and in the production process, the dimensions of the details may take into account the influence of such factors as the gap and the thickness of the shell, and that the sum of the width of the heat exchanger group and the width Wo of the jet nozzle 34 is equal to the width W of the shell 10 with a certain deviation.

EMBODIMENTS 4

Figure 9:
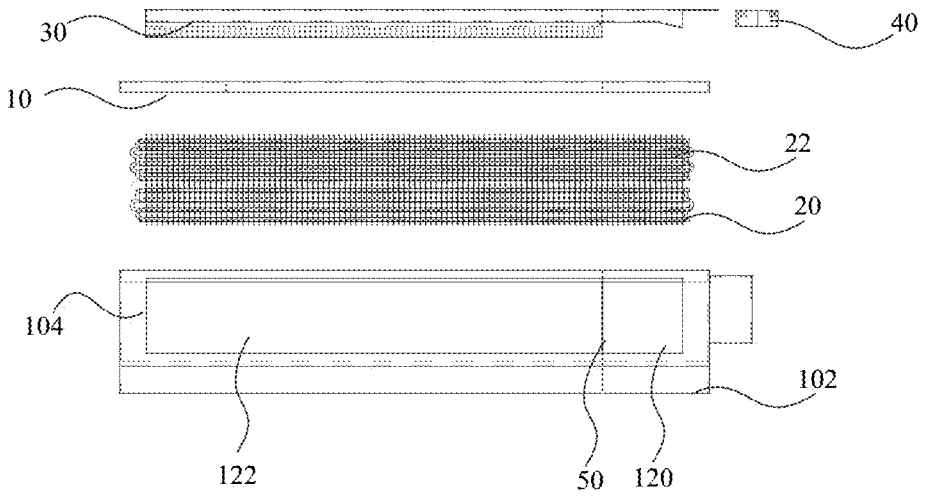
FIG. 9 shows an explosive view of the embodiments shown in FIG. 8 from a first viewing angle.
Figure 10:
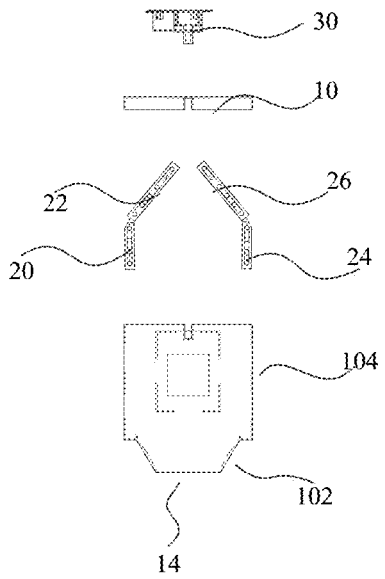
FIG. 10 shows an explosive view of the embodiments shown in FIG. 8 from a second viewing angle.
Figure 11:
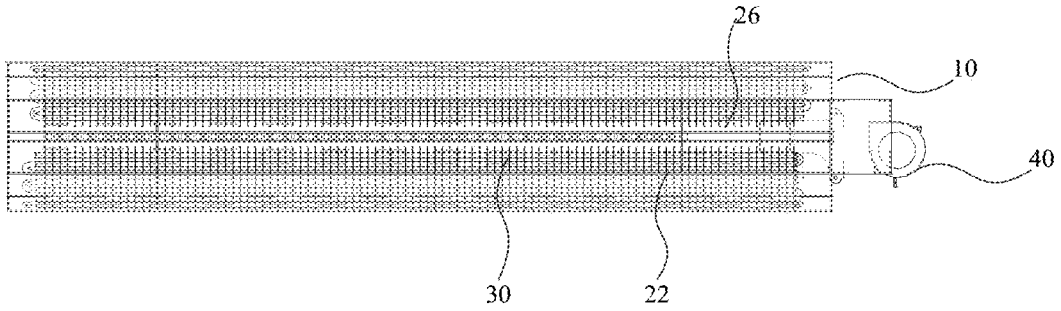
FIG. 11 shows a schematic view of the structure of the embodiments of FIG. 8 from a third viewing angle.
Figure 12:
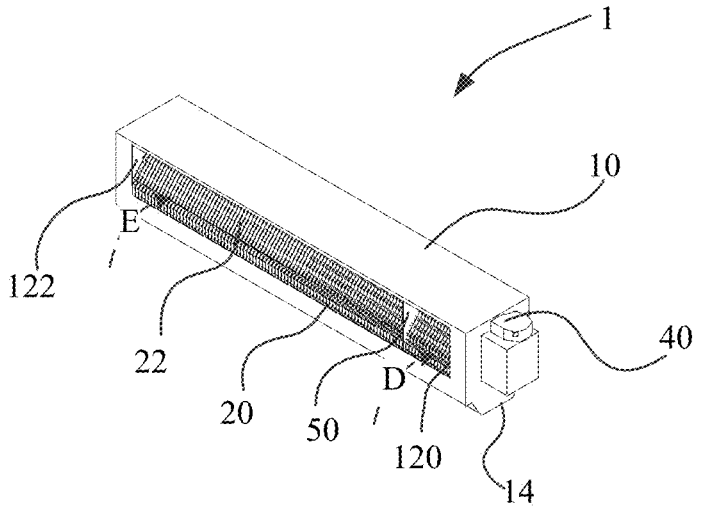
FIG. 12 shows a schematic view of the structure of an air conditioner indoor unit of the embodiments shown in FIG. 8.
Figure 13:
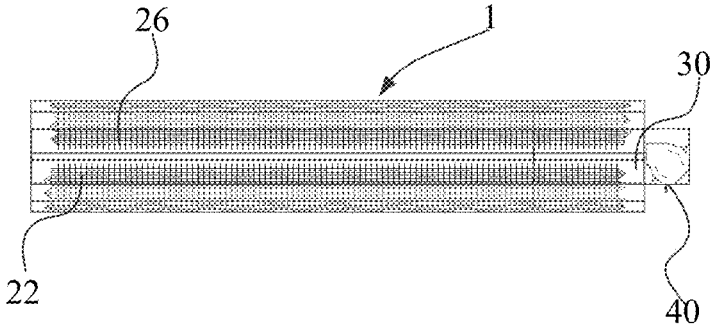
FIG. 13 shows a schematic view of the structure of the embodiments shown in FIG. 12 from a first viewing angle.
Figure 14:
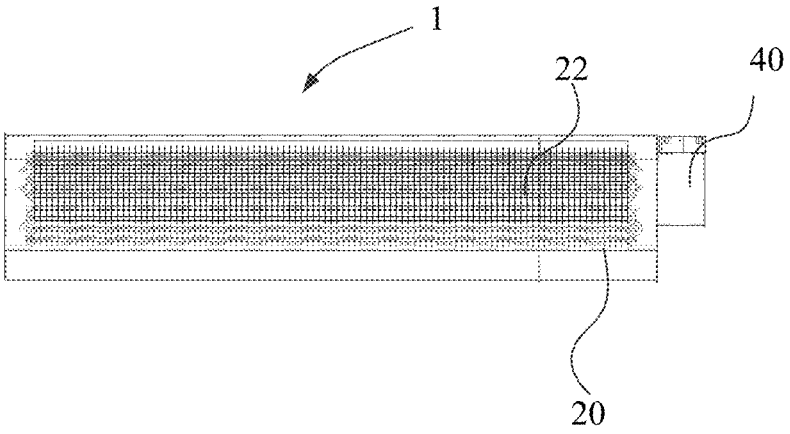
FIG. 14 shows a schematic view of the structure of the embodiments shown in FIG. 12 from a second viewing angle.

In any of the above embodiments, as shown in FIGS. 8, 9, and 10, the shell 10 includes: an air inlet cover body 104, wherein the air inlet 12 is opened in the air inlet cover body 104; a base 102, the air inlet cover body 104 being provided on the base 102, and the air outlet 14 being provided on the base 102; and a partition plate 50, wherein the partition plate 50 is arranged between the air inlet cover body 104 and the base 102, and the partition plate 50 is connected to the air inlet cover body 104 and the base 102, wherein at least one heat exchanger group is connected to the partition plate 50.

In these embodiments, the shell 10 of the air conditioner indoor unit 1 includes an air inlet cover body 104, a base 102, and a partition plate 50. The air inlet cover body 104 is provided on the base 102, and the air inlet 12 is opened in the air inlet cover body 104. The air to be performed heat exchange can enter the inner side of the shell 10 via the air inlet cover body 104 to participate in heat exchange, and at the same time, the air inlet cover body 104 can also protect a heat exchanger group provided on the inner side of the shell 10. The airflow after heat exchange by the heat exchanger group will flow to the indoor through the air outlet 14 provided in the base 102. By providing the partition plate 50 between the air inlet cover body 104 and the base 102, and connecting the partition plate 50 with the air inlet cover body 104 and the base 102, the air inlet 12 can be divided into multiple independent air inlet districts, so that the airflow participating in natural convection heat exchange and the airflow air-in participating in jet heat exchange do not interfere with each other, which is beneficial to ensure a good heat exchange capability of the natural convection heat exchange and the jet heat exchange, improving the overall heat exchange capability of the air conditioner indoor unit 1.

Further, as shown in FIG. 1, FIG. 4, FIG. 8, FIG. 10, FIG. 15, FIG. 16, and FIG. 18, any one heat exchanger group is an axisymmetric structure whose axis of symmetry extends in the first direction.

In these embodiments, the first heat exchanger 20 is arranged symmetrically to the third heat exchanger 24 and the second heat exchanger 22 is arranged symmetrically to the fourth heat exchanger 26, the axis of symmetry extending in the first direction. On the one hand, in the case where the airflow is only subjected to natural convection heat exchange through the air inlet 12 and no airflow is subjected to jet heat exchange through the jet nozzle 34, the jet nozzle 34 has little interference on the effect of natural convection and will not cause the disturbance of airflow to flow in natural convection which leads to performance attenuation, which is beneficial to ensure a good heat exchange effect.

On the other hand, in the case where the airflow is subjected to jet heat exchange through a jet structure, the airflow ejected through the jet nozzle 34 can simultaneously guide the indoor airflow to flow into the inside of the shell 10 through the air inlets 12 located at two sides of the shell 10 to achieve the convective heat exchange. Compared with the related art that when the air conditioner indoor unit 1 performs jet heat exchange, the indoor airflow can only be guided from one side to enter the inside of the shell 10 for convective heat exchange, the convective airflow volume is greatly improved, thereby improving the ejection efficiency and improving the heat exchange capability of the air conditioner indoor unit 1 such that the air conditioner indoor unit 1 can meet the requirements of user comfort quickly and for a long time.

Further, as shown in FIG. 4, an included angle between the surface of the second heat exchanger 22 facing the air inlet 12 and the height direction of the shell 10 is defined as a first included angle $\alpha 1$, and the included angle between the surface of the fourth heat exchanger 26 facing the air inlet 12 and the height direction of the shell 10 is defined as a second included angle α2; by reasonably setting the value ranges of the first included angle α1 and the second included angle α2, on the one hand, the inclined angles of the second heat exchanger 22 and the fourth heat exchanger 26 can be reasonably set according to the cubage inside the shell 10 so as to achieve the maximization of the heat exchange area, and it is advantageous for the airflow to have a good sinking effect after flowing through the inclined second heat exchanger 22 and the fourth heat exchanger 26; at the same time, the second heat exchanger 22 and the fourth heat exchanger 26 are arranged to be inclined, and the inclined angles are reasonably set such that the condensed water on the second heat exchanger 22 and the fourth heat exchanger 26 flows to the bottom end along the inclined second heat exchanger 22 and the fourth heat exchanger 26, and the condensed water of the second heat exchanger 22 and the fourth heat exchanger 26 is prevented from dropping into the indoor from the air outlet 14 and causing environmental pollution, thereby in the case of improving the heat exchange capability of the air conditioner indoor unit 1, improving the reliability and cleanliness of the use of the product.

The value of the first included angle α1 is 0° to 45°, and the value of the second included angle α2 is 0° to 45°.

Specifically, the value of the first included angle α1 can be 45°, 40°, 35° or other angles meeting the requirements; the value of the second included angle α2 can be 45°, 40°, 35° or other angles meeting the requirements. Further, the angle values of the first included angle α1 and the second included angle α2 can be the same or different, so as to meet the requirements of different structures of the second heat exchanger 22, the fourth heat exchanger 26, and the side wall of the shell 10, thereby expanding the range of the use of the product.

Further, the included angle between the surface of the first heat exchanger 20 facing the air inlet 12 and the height direction of the shell 10 is defined as a third included angle, and the included angle between the surface of the third heat exchanger 24 facing the air inlet 12 and the height direction of the shell 10 is defined as a fourth included angle; the value ranges of the third included angle and the fourth included angle are reasonably set according to the space inside the shell 10, so as to realize the reasonable setting of the installation positions of the first heat exchanger 20 and the third heat exchanger 24, thereby improving the utilization rate of the inner space of the shell 10 so as to provide a large heat exchange capability and improve the energy efficiency of the air conditioner in the case where the shell 10 is compact in volume.

Specifically, considering the problems of design and installation errors, or other problems, namely, considering a certain fault-tolerant space, by reasonably setting the third included angle and the fourth included angle, the value ranges of the third included angle and the fourth included angle are 0° to 10° such that the central planes of the first heat exchanger 20 and the third heat exchanger 24 are approximately parallel to the height of the shell 10. Then in a projection plane obtained by projecting to a plane perpendicular to the height direction, in the width direction of the shell 10, the widths of the first heat exchanger 20, the second heat exchanger 22, the third heat exchanger 24, and the fourth heat exchanger 26 are made as equal as possible to the difference value between the width of the shell 10 and the width of the jet nozzle 34 to improve the heat exchange capability and energy efficiency of the air conditioner indoor unit 1.

Specifically, the value of the third included angle may be 0°, 5°, 10° or other angles meeting the requirements; the value of the fourth included angle may be 0°, 5°, 10° or other angles meeting the requirements. Further, the angle values of the third included angle and the fourth included angle may be the same or different, so as to meet the requirements of different structures of the first heat exchanger 20, the third heat exchanger 24, and the side wall of the shell 10, thereby expanding the scope of the use of the product.

Further, as shown in FIG. 4, it is sectioned along the first direction. In the cross-section, along the first direction, the height of the air inlet 12 located at one side of the top of the shell 10 is higher than the height corresponding to the first heat exchanger 20 and the second heat exchanger 22, and the height of the air inlet 12 located at one side of the air outlet 14 is higher than the height corresponding to the first heat exchanger 20 and the second heat exchanger 22. The distance shown by Ho in FIG. 4 is the height of the first heat exchanger 20 and the second heat exchanger 22, and as shown in FIGS. 4 and 15, the height of the air inlet 12 is Hin. The arrangement is such that the airflow entering the inside of the shell 10 through the air inlet 12 can enter the heat exchange chamber after passing through the heat exchanger group, so as to prevent the airflow entering the heat exchange chamber without passing through the heat exchanger group and thus avoiding causing return air and reducing the heat exchange capability, thereby ensuring a good heat exchange capability.

Further, the jet angle θ of the jet structure 30 meets the tan(θ/2) equal to the ratio of the turbulence coefficient to 0.29, wherein the turbulence coefficient ranges from 0.05 to 0.08. By reasonably limiting the value range of the turbulence coefficient and by limiting the jet angle and turbulence coefficient of the jet structure 30, the size of the jet angle can be reasonably limited such that the jet angle matches with the air outlet 14, which is beneficial to improve the jet performance and ensure a good heat exchange capability.

As shown in FIGS. 4 and 15, along the width direction of the shell 10, the width of the jet nozzle 34 is defined as a first width Wo, the width of the air outlet 14 is defined as a second width Wout, and the width of the shell 10 is defined as a third width W; along the height direction of the shell 10, the distance between the end face of the jet nozzle 34 and the plane where the air outlet 14 is located is defined as a third distance He. By limiting that the ratio of 0.5 times the difference value between the second width and the first width to the third distance is less than tan(θ/2), namely $\tan(\theta/2) \geq 0.5(Wout-Wo)/He$, the matching degree between the jet angle θ and the air outlet 14 can be improved to avoid that the jet angle is so small that the jet region cannot cover the air outlet 14, and that the wall surface of the shell 10 around the air outlet 14 will generate condensed water due to the backflow of the airflow outside the shell 10 to affect the normal use; at the same time, it avoids that the jet angle is too large and that the jet coverage area covers the air outlet 14 too much, and that there will be many jets impacting on the wall surface on both sides of the air outlet 14 to cause performance attenuation, and therefore the reliability of the use of the product can be improved while ensuring that the jet has a good heat exchange performance.

Specifically, the jet angle θ is the angle that appears when the airflow naturally diffuses after being ejected through the jet nozzle 34, i.e., the included angle between the streamline on the outer side of the fluid and the center line of the jet nozzle 34 after the airflow is ejected through a jet mouth. As shown in FIG. 22, the angle θ in FIG. 22 is the jet angle. FIG. 23 shows a capability effect drawing when the jet angle θ does not meet the above relationship, that is, when the jet angle θ is small, causing the backflow of two side wall surfaces, on the basis of the structure of the air conditioner indoor unit 1 provided by the present disclosure. Wherein, the lower portion two elliptical regions shown in FIG. 23 cause a problem that the indoor airflow flows into the heat exchange chamber 16 through these regions as the range of the jet does not cover these regions, i.e., causing the backflow to affect the heat exchange capability.

Further, the ratio of the second width Wout to the third distance He ranges from 0.1 to 0.7, i.e., Wout/He equals 0.1 to 0.7.

Specifically, by limiting the ratio of the second width Wout to the third distance He to be within a reasonable range, the jet angle can better match the size of the air outlet 14 such that the jet region can agree with the size of the air outlet 14, which is advantageous to improve the jet performance and ensure a good heat exchange capability.

Specifically, the ratio Wout/He of the second width Wout to the third distance He is 0.1, 0.3, 0.5, 0.7, or other numerical values that meet the requirements.

Further, the ratio of the second width Wout to the third width W ranges from 0.2 to 0.9, i.e., Wout/W equals 0.2 to 0.9.

Specifically, in the case where the airflow is subjected to natural convection heat exchange through the air inlet 12, the smaller the width of the air outlet 14 is, the more seriously the heat exchange capability of the natural convection attenuates; therefore, by defining the width of the shell 10 as a third width W along the width direction of the shell 10, and limiting the ratio of the second width Wout to the third width W within a reasonable range, namely, by reasonably limiting the width of the shell 10 and the width of the air outlet 14, the airflow can be smoothly and quickly output to the indoor through the air outlet 14 after the airflow is subjected to heat exchange with the heat exchanger group through the air inlet 12 so as to ensure a good heat exchange capability.

Specifically, the ratio Wout/W of the second width Wout to the third width W may be 0.2, 0.5, 0.7, or 0.9, as well as other numerical values meeting the requirements.

Further, the air conditioner indoor unit 1 further comprises a first water receiving tray 60 and a second water receiving tray 62, the first water receiving tray 60 and the second water receiving tray 62 being provided inside the shell 10. The first water receiving tray 60 is located below the first heat exchanger 20 and used for collecting or accommodating the condensed water of the first heat exchanger 20 and the second heat exchanger 22. The second water receiving tray 62 is located below the third heat exchanger 24 and used for collecting or accommodating the condensed water of the third heat exchanger 24 and the fourth heat exchanger 26 so as to avoid the condensed water of the first heat exchanger 20, the second heat exchanger 22, the third heat exchanger 24, and the fourth heat exchanger 26 flowing into the indoor to affect the user's normal use and to improve the reliability of the use of the product.

Further, the projection is performed in a direction perpendicular to the height direction along the height direction of the shell 10. In the obtained projection plane, as shown in FIGS. 4 and 15, the projections of the end portions on the sides of the first heat exchanger 20 and the second heat exchanger 22 facing the air outlet 14 is located inside the projection of the first water receiving tray 60 such that it can be ensured that the condensed water of the first heat exchanger 20 and the second heat exchanger 22 can fall into the inside of the first water receiving tray 60 without leaking. Similarly, the projections of the end portions on the sides of the third heat exchanger 24 and the fourth heat exchanger 26 facing the air outlet 14 are located inside the projection of the second water receiving tray 62. It can be ensured that the condensed water of the third heat exchanger 24 and the fourth heat exchanger 26 can fall into the inside of the second water receiving tray 62 without leaking, thereby improving the reliability and satisfaction of the customer use.

Further, both the first water receiving tray 60 and the second water receiving tray 62 are inclined with respect to the length direction of the shell 10; the included angle between the water receiving surface of the first water receiving tray 60 and the length direction of the shell 10 has a value range of greater than or equal to 3°; the included angle between the water receiving surface of the second water receiving tray 62 and the length direction of the shell 10 has a value range of greater than or equal to 3°.

Specifically, the first water receiving tray 60 and the second water receiving tray 62 are inclined with respect to the length direction of the shell 10. By reasonably setting the range of the included angle between the water receiving surface of the first water receiving tray 60 and the length direction of the shell 10 and the range of the included angle between the water receiving surface of the second water receiving tray 62 and the length direction of the shell 10, it is advantageous for the condensed water to be smoothly discharged along one ends of the first water receiving tray 60 and the second water receiving tray 62, so as to prevent the condensed water of the first water receiving tray 60 and the second water receiving tray 62 from falling into the room because the condensed water gathers too much to be discharged in time, thereby further improving the reliability of the use of the product.

Specifically, the included angle between the water receiving surface of the first water receiving tray 60 and the length direction of the shell 10 is 3°, 4°, 5°, or other angles meeting the requirements. The included angle between the water receiving surface of the second water receiving tray 62 and the length direction of the shell 10 is 3°, 4°, 5°, or other angles meeting the requirements. It is to be understood that the first water receiving tray 60 and the second water receiving tray 62 may also be inclined with respect to the width direction of the shell 10.

Further, the first heat exchanger 20 comprises multiple first heat exchange tubes and multiple first fins, wherein multiple first heat exchange tubes are all arranged in a single row, and multiple first fins are sleeved on the first heat exchange tubes; the second heat exchanger 22 comprises multiple second heat exchange tubes and multiple second fins, wherein multiple second heat exchange tubes are all arranged in a single row, and multiple second fins are sleeved on the second heat exchange tubes; the third heat exchanger 24 comprises multiple third heat exchange tubes and multiple third fins, wherein multiple third heat exchange tubes are all arranged in a single row, and multiple third fins are sleeved on the third heat exchange tubes; the fourth heat exchanger 26 comprises multiple fourth heat exchange tubes and multiple fourth fins, wherein multiple fourth heat exchange tubes are arranged in a single row, and multiple fourth fins are sleeved on the fourth heat exchange tubes.

In these embodiments, by arranging multiple first heat exchange tubes in a single row in the first heat exchanger 20, the heat exchange performance of the first heat exchanger 20 can be effectively improved. The greater the number of the arranged first heat exchange tubes is, the more obvious the heat exchange performance is improved. Multiple first fins are sleeved on the first heat exchange tubes such that the heat of the first heat exchange tube can be uniformly distributed on the first fin. When the airflow passes through the first heat exchanger 20, the airflow can sufficiently and uniformly exchange heat with the first heat exchanger 20 such that the temperature distribution of the airflow after heat exchange is more uniformly distributed, which is beneficial to ensure a good heat exchange effect.

In the case where the heat exchanger uses a finned heat exchanger, the upper end portion of the first heat exchanger 20 and the lower end portion of the second heat exchanger 22 are overlapped via a fin; the upper end portion of the third heat exchanger 24 and the lower end portion of the fourth heat exchanger 26 are also overlapped via a fin such that the intake airflow can enter the room after heat exchange.

By arranging multiple second heat exchange tubes in a single row in the second heat exchanger 22, the heat exchange performance of the second heat exchanger 22 can be effectively improved. The greater the number of the arranged second heat exchange tubes is, the more obvious the heat exchange performance is improved. Multiple second fins are sleeved on the second heat exchange tubes such that the heat of the second heat exchange tube can be uniformly distributed on the second fin. When the airflow passes through the second heat exchanger 22, the airflow can sufficiently and uniformly exchange heat with the second heat exchanger 22 such that the temperature distribution of the airflow after heat exchange is more uniform, which is beneficial to ensure a good heat exchange effect.

By arranging multiple third heat exchange tubes in a single row in the third heat exchanger 24, the heat exchange performance of the third heat exchanger 24 can be effectively improved. The greater the number of the arranged third heat exchange tubes is, the more obvious the heat exchange performance is improved. Multiple third fins are sleeved on the third heat exchange tubes such that the heat of the third heat exchange tube can be uniformly distributed on the third fin. When the airflow passes through the third heat exchanger 24, the airflow can sufficiently and uniformly exchange heat exchange with the third heat exchanger 24 such that the temperature distribution of the airflow after heat exchange is more uniform, which is beneficial to ensure a good heat exchange effect.

By arranging multiple fourth heat exchange tubes in a single row in the fourth heat exchanger 26, the heat exchange performance of the fourth heat exchanger 26 can be effectively improved. The greater the number of the arranged fourth heat exchange tubes is, the more obvious the heat exchange performance is improved. Multiple fourth fins are sleeved on the fourth heat exchange tubes such that the heat of the fourth heat exchange tube can be uniformly distributed on the fourth fin. When the airflow passes through the fourth heat exchanger 26, the airflow can sufficiently and uniformly exchange heat with the fourth heat exchanger 26 such that the temperature distribution of the airflow after heat exchange is more uniform, which is beneficial to ensure a good heat exchange effect.

Further, the ratio of the fin pitch of two adjacent fins in the second heat exchanger 22 and the fourth heat exchanger 26 to the fin width of a single fin ranges from 0.1 to 0.45; the ratio of the fin pitch of two adjacent fins in the first heat exchanger 20 and the third heat exchanger 24 to the fin width of a single fin ranges from 0.1 to 0.45.

In these embodiments, by reasonably setting the value range of the ratio of the fin pitch of two adjacent fins in the second heat exchanger 22 and the fourth heat exchanger 26 to the fin width of a single fin, and the value range of the ratio of the fin pitch of two adjacent fins in the first heat exchanger 20 and the third heat exchanger 24 to the fin width of a single fin, it is advantageous to increase the temperature difference between the temperature of the airflow entering the shell 10 through the air inlet 12 and the temperature of the airflow in the heat exchange chamber, thereby improving the natural convection effect and ensuring a good heat exchange capability.

Specifically, the ratio of the fin pitch of two adjacent fins in the second heat exchanger 22 and the fourth heat exchanger 26 to the fin width of a single fin is 0.1, 0.2, 0.3, 0.45, or other numerical values meeting the requirements. The ratio of the fin pitch of two adjacent fins of the first heat exchanger 20 and the third heat exchanger 24 to the fin width of a single fin is 0.1, 0.2, 0.3, 0.45, or other numerical values meeting the requirements. It will be understood that the ratio of the fin pitch of two adjacent fins in the second heat exchanger 22 and the fourth heat exchanger 26 to the fin width of a single fin may or may not be the same as the ratio of the fin pitch of two adjacent fins in the first heat exchanger 20 and the third heat exchanger 24 to the fin width of a single fin.

EMBODIMENTS 5

Figure 20:
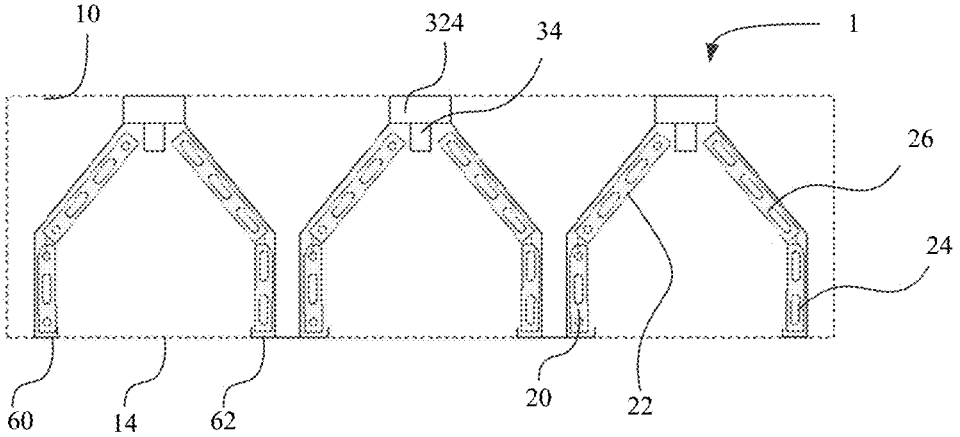
FIG. 20 is a schematic view illustrating the structure of an air conditioner indoor unit provided according to other embodiments of the present disclosure.

In some embodiments of the present disclosure, as shown in FIG. 20, at least one heat exchanger group comprises multiple heat exchanger groups, multiple heat exchanger groups being successively spaced apart along the second direction of the shell 10. Any one of the heat exchanger groups is correspondingly provided with a jet nozzle 34.

In these embodiments, multiple heat exchanger groups spaced apart along the second direction are arranged in the shell 10 of the air conditioner indoor unit 1, so as to greatly improve the heat exchange capability of the air conditioner indoor unit 1; any heat exchanger group is correspondingly provided with a jet nozzle 34 such that multiple heat exchange chambers 16 can be formed in the shell 10 and each heat exchange chamber 16 exchanges heat by means of a combination of jet flow and natural convection. On the one hand, the heat exchange capability of the air conditioner indoor unit 1 is enhanced, and on the other hand, the airflow flowing to the indoor through the air outlet 14 is more uniform, thereby improving user comfort.

EMBODIMENTS 6

On the basis of any one of the above-mentioned embodiments, as shown in FIGS. 8-15, some embodiments of the present disclosure provide an air conditioner indoor unit 1, wherein the air conditioner indoor unit 1 further comprises a fan 40 and a partition plate 50. The partition plate 50 divides an air inlet 12 into a jet air inlet 120 and a main air inlet 122, and the jet air inlet 120 is in communication with a jet air channel 324. After heat exchange by a part of a first heat exchanger 20 and a third heat exchanger 24, the air is sent into the jet air channel 324 via the fan 40 and is injected into a heat exchange chamber 16 via a jet nozzle 34; the air enters the heat exchange chamber 16 through the first heat exchanger 20, the second heat exchanger 22, the third heat exchanger 24, and the fourth heat exchanger 26 via the main air inlet 122. The heat exchange capability of the air conditioner indoor unit 1 is improved by two air inlet ways such that the overall heat exchange capability and energy efficiency of the air conditioner indoor unit 1 are improved.

The air inlet 12 is divided into a jet air inlet 120 and the main air inlet 122 by the partition plate 50 such that the airflow flowing into the inside of the shell 10 through the jet air inlet 120 and the airflow flowing into the inside of the shell 10 through the main air inlet 122 are independent and not in communication with each other, thereby ensuring that the natural convection heat exchange entering the inside of the shell 10 through the main air inlet 122 and the jet heat exchange flowing to the inside of the shell 10 through the jet air inlet 120 do not interfere with each other, which is beneficial to ensure a good heat exchange capability of the natural convection heat exchange and the jet heat exchange, improving the overall heat exchange capability of the air conditioner indoor unit 1.

Specifically, as shown in FIG. 8, the jet air inlet 120 is in communication with the jet nozzle, and the main air inlet 122 is in communication with the heat exchange chamber 16 via at least one heat exchanger group; the jet air inlet 120 is opened on the side wall of the shell 10; the main air inlet 122 is opened on two side walls of the shell 10 which are opposite along the second direction; the main air inlet 122 is opened on a side wall of the shell 10 along the third direction, and/or a top wall of the shell 10.

Further, in some embodiments of the present disclosure, as shown in FIGS. 11, 12, 13, and 14, the number of the fan 40 is one and it is provided at one end of the shell 10. The fan 40 is located outside and installed on the shell 10, and the air supply port of the fan 40 is in communication with the jet air channel 324 to provide airflow for jet heat exchange carried out by the operation of a jet structure 30. The airflow entering the main air inlet 122 is as shown by an arrow E in FIG. 12, the airflow entering the jet air inlet 120 is as shown by an arrow D in FIG. 12.

In some embodiments of the present disclosure, as shown in FIG. 16, FIG. 17, FIG. 18, and FIG. 19, the number of the fans 40 is two, respectively located at two ends of the shell 10, and the number of the partition plates 50 is two.

Wherein, two fans 40 are respectively located outside the shell 10 and installed on two ends of the shell 10. The two partition plates 50 divide the air inlet 12 into one main air inlet 122 and two jet air inlets 120. The two jet air inlets 120 are respectively located at two sides of the main air inlet 122.

Figure 16:
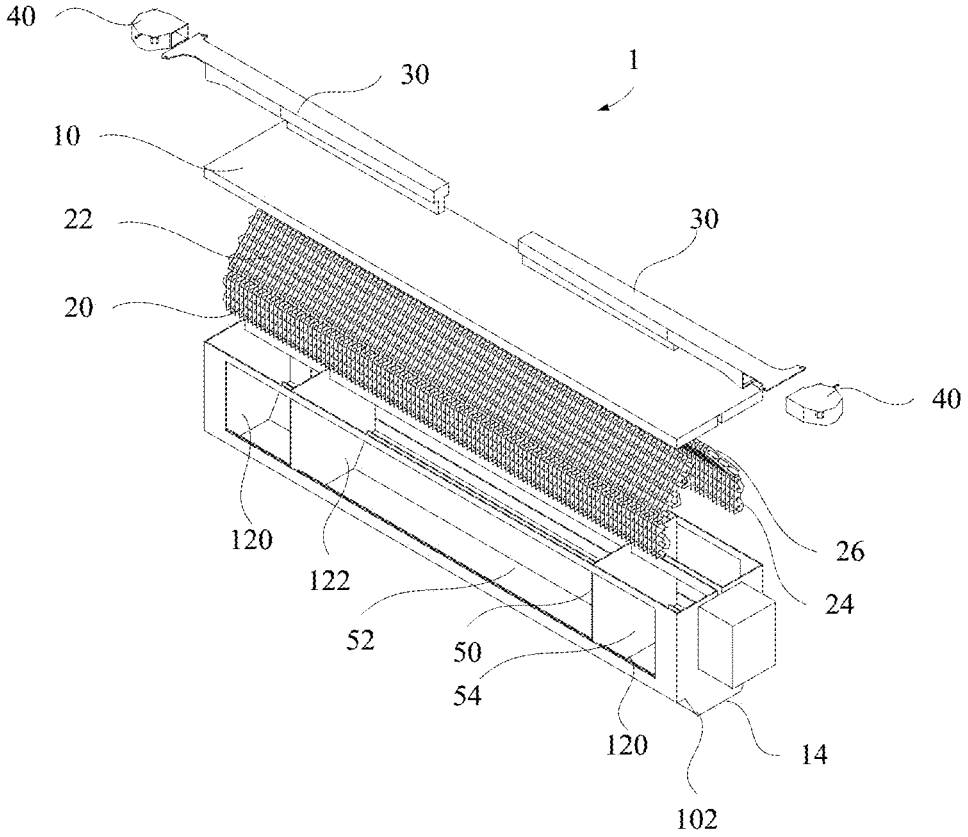
FIG. 16 shows an explosive view of an air conditioner indoor unit provided according to a third embodiments of the present disclosure.
Figure 17:
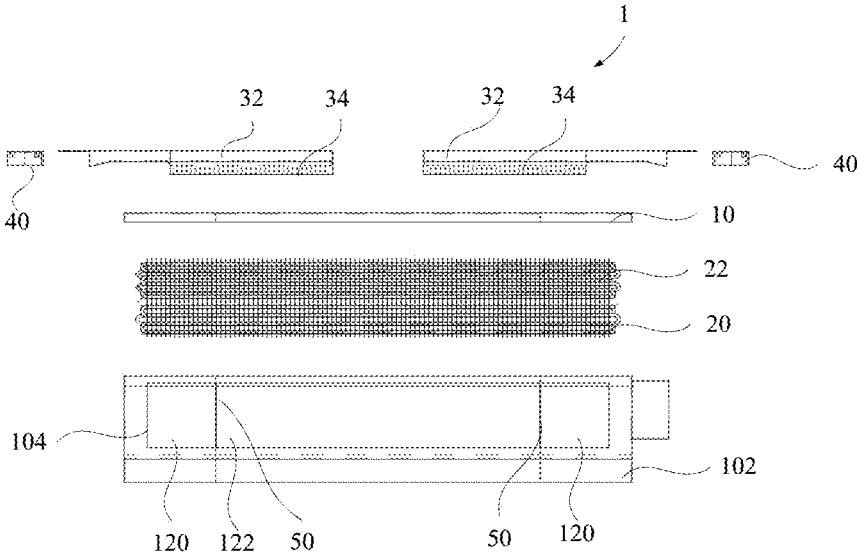
FIG. 17 shows an explosive view of the embodiments shown in FIG. 16 from a first viewing angle.
Figure 18:
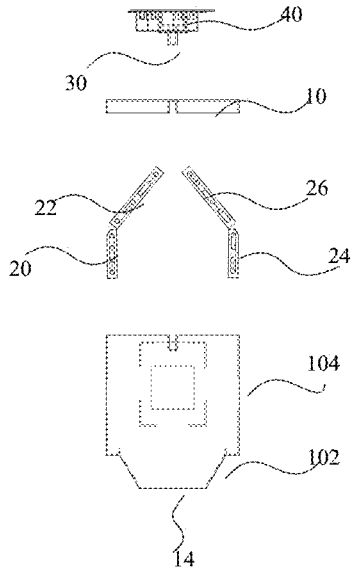
FIG. 18 shows an explosive view of the embodiments shown in FIG. 16 from a second viewing angle.
Figure 19:
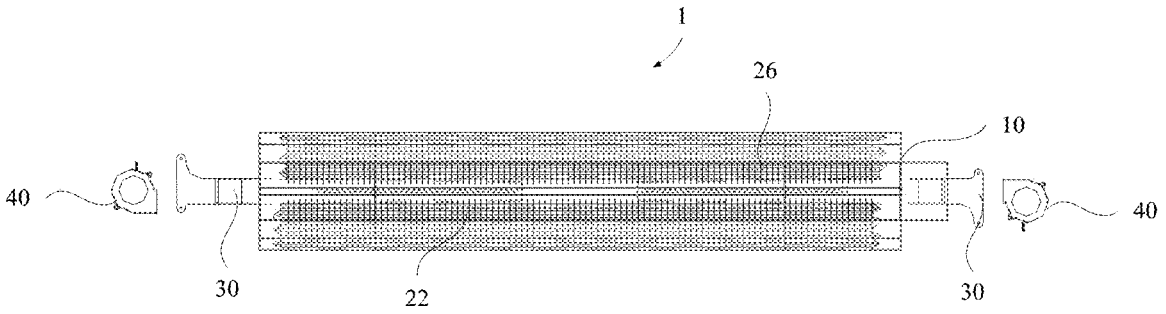
FIG. 19 shows a schematic view of the structure of the embodiments of FIG. 16 from a third viewing angle.

As shown in FIGS. 16 and 17, the jet air inlets 120 on two sides are communicated with the fans 40 on two sides, respectively. By providing two fans 40, the quantity of flow of the air for jet heat exchange is increased, and then the heat exchange capability of the jet heat exchange is improved, which is beneficial for the indoor temperature to quickly reach the user's comfort and maintain in the comfort range for a long time, thereby ensuring a good heat exchange effect.

Further, as shown in FIGS. 16 and 17, the top of the shell 10 is provided with two jet structures 30.

Specifically, on the one hand, under the action of the fan 40 on one side, the airflow passes through the jet air inlet 120 and the heat exchanger group on one side to enter the air channel 32 of one of the jet structures 30, and passes through the jet nozzle 34 on the air channel 32 to enter the heat exchange chamber 16; on the one hand, under the action of the fan 40 on the other side, the airflow passes through the jet air inlet 120 and the heat exchanger group on the other side to enter the air channel 32 of the other jet structure 30, and passes through the jet nozzle 34 on the air channel 32 to enter the heat exchange chamber 16; by providing two fans 40, the two air channels 32 provide the airflow for the jet nozzle 34 at the same time, thereby enabling the airflow to be sufficiently, smoothly, and quickly ejected via the jet nozzle 34, further increasing the quantity of flow of the air flowing to the inside of the shell 10 via the main air inlet 122, ensuring a good heat exchange capability, and improving the overall heat exchange capability of the air conditioner indoor unit 1.

Specifically, on the one hand, the air channels 32 of the two jet structures 30 are in communication and, on the other hand, the air channels 32 of the two jet structures 30 are separated, which expands the range of the use of the product.

Further, as shown in FIGS. 16 and 17, the heat exchange chamber 16 is divided into a first heat exchange chamber 52 opposite to the main air inlet 122 and two second heat exchange chambers 54 opposite to the jet air inlet 120 via two partition plates 50 such that the airflow flowing into the inside of the shell 10 via the main air inlet 122 and the airflow flowing into the inside of the shell 10 via the jet air inlet 120 are independent of each other and not communicated, namely, the two are short-circuited therebetween. It can ensure that the natural convection heat exchange entering the inside of the shell 10 via the main air inlet 122 and the jet heat exchange flowing to the inside of the shell 10 via the jet air inlet 120 do not interfere with each other, which is beneficial to ensure a good heat exchange capability of the natural convection heat exchange and the jet heat exchange, thereby improving the overall heat exchange capability of the air conditioner indoor unit 1.

EMBODIMENTS 7

According to a second aspect of the present disclosure, there is provided an air conditioner, comprising the air conditioner indoor unit 1 according to any embodiment of the above first aspect. Accordingly, it has all the advantageous effects of the air conditioner indoor unit 1 of the first aspect described above which will not be described in detail herein.

Further, the air conditioner further comprises a control system. The control system can acquire an operating mode instruction of the air conditioner, and according to the operating mode instruction, controls the air conditioner indoor unit 1 to perform natural convection heat exchange, jet heat exchange, or natural convection heat exchange and jet heat exchange together so as to meet different needs of users and to improve the user comfort to the maximum.

The air conditioner indoor unit 1 provided in the present disclosure can realize the integration of the jet heat exchange mode and the natural convection heat exchange mode, and the effects of the jet heat exchange and the natural convection heat exchange can be superimposed on each other, which is not a simple effect superposition, but also can mutually improve the effect and achieve the function of a gain effect. At the same time, by optimizing the parameters of the heat exchanger group and combining with the arrangement form of the condensed water collection, it can provide a large natural convection refrigerating capacity output with a compact volume. In the operating mode of natural convection refrigeration, there is no fan noise at all, and there is no dripping of condensed water into the room.

Specifically, the air conditioner indoor unit 1 provided in the present disclosure can be applied to a variety of products such as a household air conditioner, a central air conditioner multiple on-line, a commercial air curtain machine, a commercial air conditioner indoor terminal, etc.

In the description of the present disclosure, the term "multiple" means two or more unless explicitly defined otherwise. The orientation or positional relationship indicated by the terms "upper", "lower", etc. is the orientation or positional relationship described based on the accompanying drawings, which is only for the convenience of describing the present disclosure and simplifying the description, rather than indicating or implying that the indicated device or element must have a specific orientation or is constructed and operated in a specific orientation, and therefore should not be construed as a limitation of the present disclosure. The terms "connected", "install", "fixed", and the like are to be construed broadly, e.g., "connected" may be a fixed connection, a detachable connection, or an integral connection; and may be directly connected or indirectly connected through an intermediary. For a person of ordinary skills in the art, the specific meaning of the above terms in the present disclosure can be understood according to specific situations.

In the description of the present disclosure, the description of the terms "one embodiment", "some embodiments", "specific embodiments", etc. means that a specific feature, structure, material, or feature described in connection with the embodiment or example is included in at least one embodiment or example of the present disclosure. In the present disclosure, schematic representations of the above terms do not necessarily refer to the same embodiment or example. Further, the specific features, structures, materials, or characteristics described may be combined in a suitable manner in any one or more embodiments or examples.

The above descriptions are only preferred embodiments of the present disclosure, and are not intended to limit the present disclosure. For those skilled in the art, the present disclosure may have various modifications and changes. Any modification, equivalent replacement, improvement, etc. made within the spirit and principle of the present disclosure shall be included within the scope of the present disclosure.

What is claimed is:

1. An air conditioner indoor unit, comprising:

a shell, comprising an air inlet and an air outlet, the air outlet being located at a bottom of the shell along a first direction; and at least one heat exchanger group, being provided in the shell, and air flowing through the air inlet to the at least one heat exchanger group for heat exchange and then flowing out from the air outlet, wherein any one of the at least one heat exchanger group comprises:

a first heat exchanger;

a second heat exchanger, wherein a first connecting line between an upper end portion and a lower end portion of the second heat exchanger is arranged to be inclined with respect to the first direction, and the lower end portion of the second heat exchanger is provided adjacent to an upper end portion of the first heat exchanger;

a third heat exchanger, being spaced from the first heat exchanger along a second direction;

a fourth heat exchanger, wherein a second connecting line between an upper end portion and a lower end portion of the fourth heat exchanger is arranged to be inclined with respect to the first direction, and the lower end portion of the fourth heat exchanger is provided adjacent to an upper end portion of the third heat exchanger; and a jet nozzle, being located between the upper end portion of the fourth heat exchanger and the upper end portion of the second heat exchanger, the jet nozzle enclosing with any one of the at least one heat exchanger group to form a heat exchange chamber, and the heat exchange chamber being in communication with the air outlet, wherein the upper end portion of the fourth heat exchanger is connected to the upper end portion of the second heat exchanger, the first direction is perpendicular to the second direction, the first direction is a direction of gravity, and an intersection point of an extension line of the first connecting line and an extension line of the second connecting line is located between the first heat exchanger and the third heat exchanger.

2. The air conditioner indoor unit according to claim 1, wherein a cross-sectional shape constituted by the second heat exchanger and the fourth heat exchanger is an inverted V-shape in a cross-section perpendicular to a third direction;

wherein the third direction is perpendicular to both the first direction and the second direction.

3. The air conditioner indoor unit according to claim 1, further comprising:

a jet air channel, being in communication with the jet nozzle, a cross-sectional area of the jet air channel gradually decreasing along a flow direction of the jet air channel.

4. The air conditioner indoor unit according to claim 1, wherein the at least one heat exchanger group comprises multiple heat exchanger groups, wherein the multiple heat exchanger groups are successively spaced apart along the second direction of the shell, and any one of the heat exchanger group is correspondingly provided with the jet nozzle.

5. The air conditioner indoor unit according to claim 1, wherein the shell comprises:

an air inlet cover body, the air inlet being opened on the air inlet cover body;

a base, the air inlet cover body being provided on the base, and the air outlet being opened on the base; and a partition plate, being provided between the air inlet cover body and the base, the partition plate being connected to the air inlet cover body and the base, wherein the at least one heat exchanger group is connected to the partition plate.

6. The air conditioner indoor unit according to claim 1, wherein any one of the at least one heat exchanger group is an axisymmetric structure having an axis of symmetry extending along the first direction.

7. The air conditioner indoor unit according to claim 1, wherein the second heat exchanger comprises multiple second fins and the fourth heat exchanger comprises multiple fourth fins, an inclination angle of the second fin with respect to the first direction ranges from 0° to 4°, an inclination angle of the fourth fin with respect to the first direction ranges from 0° to 45°.

8. The air conditioner indoor unit according to claim 1, wherein along the second direction, a ratio of a width of the air outlet to a width of the shell ranges from 0.2 to 0.9; and/or a ratio of a width of the air outlet along the second direction to a distance from an end face of the jet nozzle to a plane where the air outlet is located ranges from 0.1 to 0.7.

9. The air conditioner indoor unit according to claim 1, wherein projection is performed along the first direction of the shell to a plane perpendicular to the first direction, in an obtained projection plane, a width of the at least one heat exchanger group is equal to a difference value between the width of the shell and a width of the jet nozzle.

10. The air conditioner indoor unit according to claim 1, wherein the air inlet is higher than the lower end portion of the at least one heat exchanger group, at one side of the air outlet along the first direction of the shell.

11. The air conditioner indoor unit according to claim 1, wherein the first heat exchanger comprises multiple first heat exchange tubes and multiple first fins, wherein the multiple first heat exchange tubes are all arranged in a single row, and the multiple first fins are sleeved on the first heat exchange tubes, the second heat exchanger comprises multiple second heat exchange tubes and multiple second fins, wherein the multiple second heat exchange tubes are all arranged in a single row, and the multiple second fins are sleeved on the second heat exchange tubes, the third heat exchanger comprises multiple third heat exchange tubes and multiple third fins, wherein the multiple third heat exchange tubes are all arranged in a single row, and the multiple third fins are sleeved on the third heat exchange tubes, the fourth heat exchanger comprises multiple fourth heat exchange tubes and multiple fourth fins, wherein the multiple fourth heat exchange tubes are arranged in a single row, and the multiple fourth fins are sleeved on the fourth heat exchange tubes.

12. The air conditioner indoor unit according to claim 1, wherein the air inlet comprises a jet air inlet and a main air inlet, wherein the jet air inlet is in communication with the jet nozzle, and the main air inlet is in communication with the heat exchange chamber via the at least one heat exchanger group, the jet air inlet is opened on a side wall of the shell, the main air inlet is opened on two side walls of the shell which are opposite along the second direction, the main air inlet is opened on a side wall of the shell along a third direction and/or a top wall of the shell.

13. An air conditioner, comprising:

the air conditioner indoor unit of claim 1.

14. An air conditioner indoor unit, comprising:

a shell, comprising an air inlet and an air outlet, the air outlet being located at a bottom of the shell along a first direction; and at least one heat exchanger group, being provided in the shell, and air flowing through the air inlet to the at least one heat exchanger group for heat exchange and then flowing out from the air outlet, wherein any one of the at least one heat exchanger group comprises:

a first heat exchanger;

a second heat exchanger, wherein a first connecting line between an upper end portion and a lower end portion of the second heat exchanger is arranged to be inclined with respect to the first direction, and the lower end portion of the second heat exchanger is provided adjacent to an upper end portion of the first heat exchanger;

a third heat exchanger, being spaced from the first heat exchanger along a second direction; and a fourth heat exchanger, wherein a second connecting line between an upper end portion and a lower end portion of the fourth heat exchanger is arranged to be inclined with respect to the first direction, and the lower end portion of the fourth heat exchanger is provided adjacent to an upper end portion of the third heat exchanger, wherein the upper end portion of the fourth heat exchanger is connected to the upper end portion of the second heat exchanger, the first direction is perpendicular to the second direction, the first direction is a direction of gravity, an intersection point of an extension line of the first connecting line and an extension line of the second connecting line is located between the first heat exchanger and the third heat exchanger, and any one of the at least one heat exchanger group is an axisymmetric structure having an axis of symmetry extending along the first direction.

* * * * *